US010029453B2

(12) United States Patent
Kitscha

(10) Patent No.: US 10,029,453 B2
(45) Date of Patent: Jul. 24, 2018

(54) MODULAR DIGITAL INKING SYSTEM

(71) Applicant: QUAD/TECH, INC., Sussex, WI (US)

(72) Inventor: John Kitscha, Brookfield, WI (US)

(73) Assignee: Baldwin Americas Corporation, St. Louis, MO (US)

( * ) Notice: Subject to any disclaimer, the term of this patent is extended or adjusted under 35 U.S.C. 154(b) by 0 days.

(21) Appl. No.: 15/495,045

(22) Filed: Apr. 24, 2017

(65) Prior Publication Data

US 2017/0305144 A1 Oct. 26, 2017

Related U.S. Application Data

(60) Provisional application No. 62/326,927, filed on Apr. 25, 2016.

(51) Int. Cl.
*B41F 31/08* (2006.01)
*B41F 31/26* (2006.01)
*B41F 17/14* (2006.01)

(52) U.S. Cl.
CPC ..... *B41F 31/26* (2013.01); *B41F 17/14* (2013.01); *B41F 31/08* (2013.01)

(58) Field of Classification Search
CPC ..... B41F 31/02; B41F 31/027; B41F 31/04; B41F 31/08; B41F 31/26; B41F 31/28
See application file for complete search history.

(56) References Cited

U.S. PATENT DOCUMENTS 4,643,092 A 2/1987 Yamagishi et al.
5,472,324 A 12/1995 Atwater
5,482,448 A 1/1996 Atwater et al.
5,957,051 A 9/1999 Atwater
6,168,268 B1 1/2001 Sugiyama
6,190,454 B1 2/2001 Anderson
6,513,430 B1 2/2003 Atwater
(Continued)

FOREIGN PATENT DOCUMENTS

WO WO0000353 1/2000
WO WO2004/113076 12/2004
WO WO2008/151246 12/2008

OTHER PUBLICATIONS

International Search Report and Written Opinion of the ISA, PCT/US2017/029156, dated Jul. 26-27, 2017, 12 pages.
(Continued)

*Primary Examiner* — Leslie J Evanisko
(74) *Attorney, Agent, or Firm* — Becker Patent Law, LLC

(57) ABSTRACT

A printing press for printing on metal cans includes a plurality of inkers. Each inker prints a different color ink on the cans, and includes a first module, a second module, a roller and a support member. The first module has motors to drive output shafts. The second module has ink displacement units, an ink inlet to provide ink to the ink displacement units, ink channels to transfer ink from the ink displacement units to ink outlets of the second module and input shafts to removably couple to the output shafts of the first module. The roller receives ink from the ink displacement units and transfers the ink toward the cans. The support member supports the first and second modules in at least one position relative to the roller. The support member facilitates removal of the second module by a press operator for cleaning the ink channels.

11 Claims, 18 Drawing Sheets

(56) References Cited

U.S. PATENT DOCUMENTS

| | | | | |
|---|---|---|---|---|
| 6,712,447 | B2 | 3/2004 | Saito | |
| 6,746,109 | B2 | 6/2004 | Samuels | |
| 6,769,357 | B1 | 8/2004 | Finan | |
| 6,810,805 | B1 | 11/2004 | Atwater | |
| 6,895,191 | B2 | 5/2005 | Rommelmann et al. | |
| 6,951,174 | B2 | 10/2005 | Price et al. | |
| 7,021,743 | B2 | 4/2006 | Flotats et al. | |
| 7,291,002 | B2 | 11/2007 | Russell et al. | |
| 7,373,878 | B2 | 5/2008 | Finan | |
| 7,387,359 | B2 | 6/2008 | Hernandez et al. | |
| 7,621,217 | B2 | 11/2009 | Atwater et al. | |
| 7,752,965 | B2 | 7/2010 | Atwater et al. | |
| 7,756,454 | B2 | 7/2010 | Crean et al. | |
| 8,118,399 | B2 | 2/2012 | Kanbara et al. | |
| 8,360,560 | B2 | 1/2013 | Omer et al. | |
| 9,132,664 | B2 | 9/2015 | Schach | |
| 2007/0089619 | A1 | 4/2007 | Finan | |
| 2008/0022877 | A1* | 1/2008 | Gail | B41F 7/32 101/480 |
| 2008/0302260 | A1 | 12/2008 | Atwater | |
| 2009/0211474 | A1 | 8/2009 | Atwater | |
| 2013/0098256 | A1 | 4/2013 | Bonner | |
| 2013/0100207 | A1 | 4/2013 | Van Der Zwan | |
| 2015/0174893 | A1 | 6/2015 | Telljohann | |
| 2015/0375497 | A1 | 12/2015 | Stowe et al. | |

OTHER PUBLICATIONS

"Flexible Module Printer . . . ," printed from the Internet at http://www.fujitsu.com/jp/group/fcl/en/resources/news/pressreleases/2012/20120221.html on Apr. 24, 2017, 2 pages.

Techniques Exchange, www.infra-nt.com, newspaper technologies, "Digital inking vs. open fountain," Jul. 2005, 2 pages.

Goss International, "Goss DigiRail Digital Inking," printed from the internet at http://vvww.gossinternational.com/page/gos-sdigiraildigitalinking/ on Apr. 12, 2016, 2 pages.

"Evolis Quantum 2," printed from http://www.cardlogix.com/products/printers/evolis-quantum-2-id-card-printer.asp on Apr. 24, 2017, 15 pages.

* cited by examiner

MODULAR DIGITAL INKING SYSTEM

CROSS-REFERENCE TO RELATED PATENT APPLICATIONS

This application claims the benefit of and priority to U.S. Provisional Patent Application No. 62/326,927, filed Apr. 25, 2016. The entire disclosure of this patent application is incorporated by reference herein.

BACKGROUND

The present application relates generally to the field of printing systems. In some implementations, the present application relates more specifically to decorator presses.

In the printing industry, printing presses, such as web offset presses, typically have multiple printing stations, each printing station having a different color ink (such as Cyan, Magenta, Yellow and Black). Each printing station is dedicated for printing a particular ink color.

In other presses, an inking station may print one color for a first print run and then be filled with a different color for a second print run. One such example is a printing press for printing cans, such as soda cans, which is known as a decorator. The process of changing from the first color to the second color is called a color changeover.

Color changeovers can lead to significant press downtime. A changeover occurs, for example, when one of the inker's roller trains and ink distribution head is cleaned and then coupled to a source of a different colored ink. In one embodiment, the inkers may be mounted on a swing assembly that swings away from the press so that they can more readily be cleaned. The pump unit of the inker alone can weigh 50-60 lbs.

SUMMARY

One implementation of the present disclosure is a printing press for printing on objects. In some implementations, the printing press is a decorator press for printing on metal cans or other objects (e.g., cylindrical objects). The press includes a conveyor configured to move cans through the press. The press further includes a plurality of inkers, each inker configured to print a different color ink on the cans. Each inker includes an ink distribution module that includes a first module comprising a plurality of motors, each motor configured to drive an output shaft and a second module. The second module includes a plurality of ink displacement units, at least one ink inlet to provide ink to the ink displacement units, ink channels configured to transfer ink from the ink displacement units to ink outlets of the second module, and input shafts configured to removably couple to the output shafts of the first module. The press further includes at least one roller configured to receive ink from the ink displacement units and transfer the ink toward the cans and at least one support member configured to support the first and second modules in at least one position relative to the roller. The support member is configured to facilitate removal of the second module by a press operator for cleaning the ink channels.

In some embodiments, the first module and the second module are connected to a base plate. In some embodiments, the support member includes the base plate. In some embodiments, the support member includes a rail that the base plate is configured to ride on between an operating position and a removal position. The support member may include a lever coupled to the base plate and a gas strut, the lever may work against the gas strut. The gas strut may be coupled to the support member. In some embodiments, actuating the lever causes the base plate to move between the operating position and the removal position, moving the first and second modules between the operating position and the removal position.

In some embodiments, the input shafts and the output shafts mechanically self-align via a tongue-and groove configuration. In some embodiments, the input shafts include tongue protrusions that are configured to lock with grooves of the output shafts. In some embodiments, the output shafts include grooves that are configured to lock with tongue protrusions of the input shafts.

In some embodiments, the input shafts and the output shafts mechanically self-align via one or more pins and a plurality of pin receivers. In some embodiments, each of the input shafts and each of the output shafts mechanically self-align via one or more pins and a plurality of pin receivers. Each of the input shafts include one or more pins and each of the output shafts include a plurality of pin receivers. In some embodiments, the one or more pins of the input shafts mechanically self-align with the plurality of pin receivers of the output shafts. The one or more pins can be configured to fit within the pin receivers. The plurality of pins may have angled tips configured to mechanically self-align with one of the pin receivers regardless of the rotational position of the input shaft and the output shaft. The plurality of pin receivers may be spaced a predefined distance in a circular pattern on a face of the output shaft such that the plurality of pins mechanically self-align with the pin receivers regardless of the rotational position of the input shaft and the output shaft.

In some embodiments, the input shafts and the output shafts are paired such that each of the input shafts are paired with one of the output shafts. In some embodiments, one of the pairs of the input shafts and the output shafts are magnetically coupled. In some embodiments, all of the pairs of the input shafts and the output shafts are magnetically coupled. In some embodiments, a portion of the pairs of the input shafts and the output shafts are magnetically coupled. The input shaft of the magnetically coupled pair may include a magnetic material and the output shaft of the magnetic pair includes a material attracted to the magnet material. In some embodiments, the output shaft of the magnetic pair includes a magnetic material and the input shaft of the magnetic pair includes a material attracted to the magnetic material. In some embodiments, the material attracted to the magnetic material is another magnetic material of an opposite magnetic pole with reference to a pole of the magnetic material.

In some embodiments, the first module further includes a circuit board including electrical components configured to power the motors at different speeds based on control signals received at a control input port. In some embodiments, the ink displacement units are configured for positive displacement pumping of ink. In some embodiments, the second module has at least four separate ink displacement units. In some embodiments, the second module weighs less than about 30 pounds. In some embodiments, the second module includes a distribution head configured to spread the ink received from across zones of the roller. In some embodiments, the first module is free of any ink channels. In some embodiments, the input shafts and output shafts are configured to mechanically self-align. In some embodiments, the input shafts and output shafts are configured to magnetically couple. In some embodiments, the support includes a rail and the first and second modules are configured to slide along the rail between an operating position and a removal position. In some embodiments, the slide is configured to release the second module when in the removal position.

Another implementation of the present disclosure is a digital inking system for a printing press for printing on objects. In some implementations, the printing press is a decorator press for printing on metal cans or other objects (e.g., cylindrical objects). The press includes a first module including a plurality of motors, each motor configured to drive an output shaft. The press further includes a second module including a plurality of ink displacement units, at least one ink inlet to provide ink to the ink displacement units, ink channels configured to transfer ink from the ink displacement units to ink outlets of the second module, and input shafts configured to removably couple to the output shafts of the first module. At least one of the first and second module includes a coupling mechanism configured to hold the modules together in a first position and to release the modules from one another in a second position. At least one support member configured to support the first and second modules in at least one position relative to the roller. The support member is configured to facilitate removal of the second module by a press operator for cleaning the ink channels.

In some embodiments, the coupling mechanism is configured to move from the first position to the second position by a press operator without requiring a tool. In some embodiments, the input shafts and output shafts are configured to be separated by a press operator without requiring a tool.

Another implementation of the present disclosure is a method of changing from a first ink to a second ink at an ink distribution module of a printing press for printing on objects. In some implementations, the printing press is a decorator press for printing on metal cans or other objects (e.g., cylindrical objects). The ink distribution module includes a first module holding a plurality of motors for driving an output shaft, a second module including ink displacement units configured to be driven by input shafts removably coupled to the output shafts, and a support member configured to support the first and second modules. The method includes sliding the first and second modules back to a first retracted position along the support member, disengaging the first module from the second module via a latch mechanism, releasing the second module from the support member, receiving on the support member a third module comprising ink displacement units configured to be driven by the input shafts of the first module, the ink displacement units of the third module being clean or comprising an ink of a different color than the ink displacement units of the second module, sliding the first module along the support member toward the third module until output shafts of the first module couple with input shafts of the third module and sliding the first and third modules along the support member into a position for inking a roller of the press.

In some embodiments, the method further includes locking the first module into place after the output shafts of the first module couple with input shafts of the third module. In some embodiments, the first module and second module are slid to the retracted positions sequentially. In some embodiments, the method further includes unlocking the first module from the second module before sliding the first module to the first retracted position.

In some embodiments, the latch mechanism is a toggle clamp. In some embodiments, the latch mechanism is one or more toggle clamps. The toggle clamp may include a catch portion and a loop portion. In some embodiments, the loop portion is connected to a lever that when actuated, causes the loop portion to latch with the catch portion or de-latch from the catch portion. In some embodiments, the first module includes one of the catch portion and the loop portion. The second module may include one of the catch portion and the loop portion. In some embodiments, the first module includes the catch portion and the second module includes the loop portion. The first module may include the loop portion and the second module may include the catch portion.

In some embodiments, the latch mechanism is a cam latch. In some embodiments, the latch mechanism is one or more cam latches. The cam latch may include a lever portion that includes a cam portion, a base, a pin, a mounting piece, and a spring surrounding the pin located between the base and the mounting piece. In some embodiments, the first module includes the base and the second module includes the mounting piece. In some embodiments, the first module includes the mounting piece and the second module includes the base. The lever can move against the base and is coupled to the pin which can cause the pin to move out of or into contact with mounting piece latching the first module to the second module or releasing the first module from the second module.

In some embodiments, the latch mechanism is a grab latch. The grab latch may include a first piece and a second piece. In some embodiments, the first portion includes a c-shaped portion and the second portion includes an o-shaped protrusion. The c-shaped portion may be a pliable material configured to open slightly and receive the o-shaped protrusion and allow the o-shaped protrusion to be removed from the c-shaped portion. In some embodiments, the first module includes the first portion and the second module includes the second portion. The first module may include the second portion and the second modules includes the first portion.

In some embodiments, the latch mechanism is a spring tension draw latch. The latch mechanism may include a first portion and a second portion. The first portion may be a hook portion. The second portion may include a lever and one or more compression springs. The second portion can be configured to latch with the hook portion. In some embodiments, when the spring tension draw latch is closed, the one or more compression springs of the second portion provide constant holding tension between the first portion and the second portion. In some embodiments, the first module includes the first portion and the second module includes the second portion. In some embodiments, the first module includes the second portion and the second module includes the first portion.

In some embodiments, a printing press for printing on objects (e.g., a decorate press, such as a decorator press for printing on cans) includes a conveyor configured to move cans through the press and a plurality of inkers, each inker configured to print a different color ink on the cans. Each inker may include an ink distribution module. The ink distribution module may include a first module and a second module. The first module can include a plurality of motors, each motor configured to drive an output shaft. The first module can further include a circuit board that includes a plurality of sensors, each sensor configured to measure a current draw of each motor, and electrical components. The electrical components can be configured to monitor the current draw of each of the plurality of motors via the plurality of sensors. The electrical components can be configured to determine if the current draw of one of the motors is above a threshold amount. The electrical components can be configured to send an alert message to an operator control system in response to determining that the temperature of one of the motors is above the threshold temperature. The alert message can indicate that a particular motor of a particular inker is experiencing a fault and that a second module of the ink distribution module should be replaced with a third module of the same construction as the second module. The ink distribution module can further include the second module. The second module can include input shafts configured to removably couple to the output shafts of the first module. The second module can include a plurality of displacement pumps, each pump controlled by one of the plurality of motors via one of the output shafts and one of the input shafts. When one of the plurality of displacement pumps is operating below a nominal performance, the current draw of a motor driving the one displacement pump may increase above the predefined amount. The press can include at least one roller configured to receive ink from the plurality of displacement pumps and transfer the ink toward the cans and at least one support member configured to support the first and second modules in at least one position relative to the roller. The support member can be configured to facilitate removal of the second module by a press operator for cleaning the ink channels.

In some embodiments, the circuit board includes a plurality of encoders that are configured to determine the speed of each of the motors. The electrical components can be configured to monitor the speed of each of the motors via the plurality of encoders. The electrical components can be configured to send the alert message to the operator computer system in response to determining that the speed of one of the plurality of motors is less than a threshold speed. When the one displacement pump is operating below a nominal performance, the speed of the motor driving the one displacement pump may increase above the predefined amount.

In some embodiments, each of the plurality of displacement pumps include a piston block that includes a cylindrical wall that a piston rotates within. The piston may be driven by the motor via the output shaft and the input shaft. In some embodiments, when one of the plurality of displacement pumps operates below the nominal performance, a nominal force exerted by the motor on the piston required to rotate the piston is insufficient to overcome a force of friction between an outer surface of the piston and an inner surface of the cylindrical wall.

DETAILED DESCRIPTION OF ILLUSTRATIVE EMBODIMENTS

One or more embodiments described herein may provide an ink distribution module that separates into one heavier module comprising, e.g. a motor drive unit, that does not require cleaning of ink and a second lighter module comprising, e.g., a pumping unit, made up of variable displacement pumps and a billet that feeds ink to the pumps and distribution head.

One or more embodiments may assemble the pump motors and/or circuit board in the first, heavier module and the pumps, ink channels (e.g., billet) that transfer ink to the pumps and distribution head in the second, lighter module.

One or more embodiments may reduce the weight of the module to be cleaned.

One or more embodiments may comprise a method of cleaning an ink distribution module by manually removing the lighter module for cleaning while a replacement module is inserted, leading to very little press downtime.

In one or more embodiments, the inker's ink distribution module may be mounted on a rail system by which it can be pulled away from the press so that the pumping unit can more readily be cleaned or replaced. The pumping unit may disconnect from the motor drive unit therefore making it easier to remove and replace. The pumping unit alone may weigh 25-30 lbs.

Figure 1:
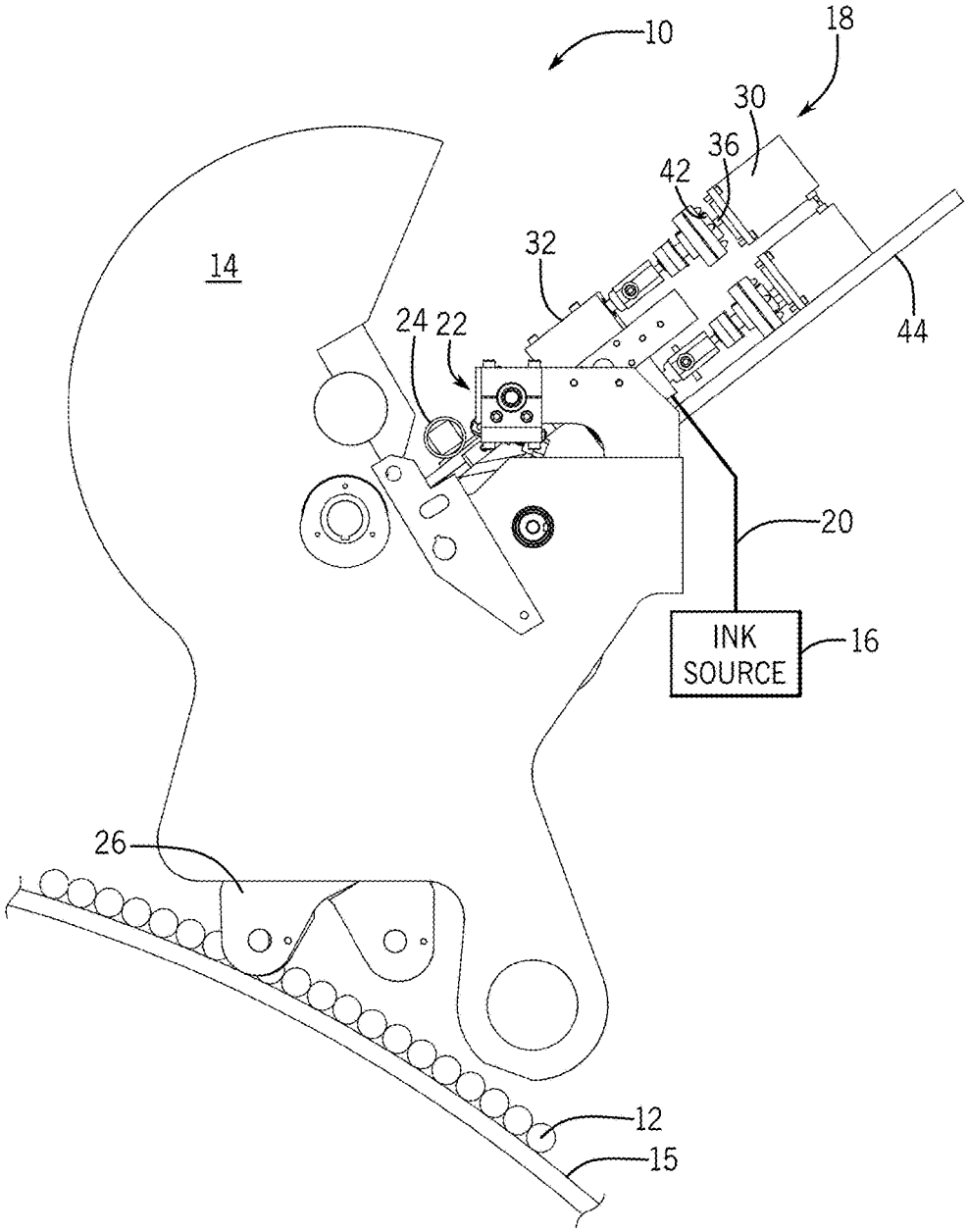
FIG. 1 is a drawing of an inker for a decorator press, according to an illustrative embodiment.

Referring now to FIG. 1, a portion of a decorator press 10 will be described. The system of FIG. 1 may be used in the vicinity of, coupled to, or otherwise working with a printing press, such as a decorator press, which may be used to print a plurality of different colors of inks. For example, a batch of metal cans 12 (which can be associated with a certain label) may be moved through decorator press 10 along a conveyor 15 as cans 12 are printed with a red ink, a black ink, a white ink, and/or other inks. Conveyor 15 may comprise any type of mechanism for moving cans 12, such as a belt, arms, holder, or other device.

A decorator press may have different colors printed from different inkers disposed at different locations around a Ferris wheel-shaped or circular-shaped press arrangement. FIG. 1 illustrates one such inker 14, according to an exemplary embodiment.

Each inker 14 may comprise an ink source 16 (e.g., can/bucket of ink) and an ink distribution module 18 which pumps the ink out of ink source 16 through a distribution head 22 portion of ink distribution module 18. Distribution head 22 spreads the pumped ink onto a primary ink roller 24 for inking a plate cylinder 26 which prints an impression on the can. Typically, a series of rollers comprising a roller train are disposed between distribution head 22 and plate cylinder 26 to distribute the ink. One or more rollers in the roller train may be configured to receive ink from distribution head 22 or from other rollers and transfer the ink toward cans 12. Portions of ink distribution module 18 (pumps, distribution head 22, etc.) are to be cleaned during a color changeover, for example for a label change or other servicing (e.g., repair, etc.).

Figure 2:
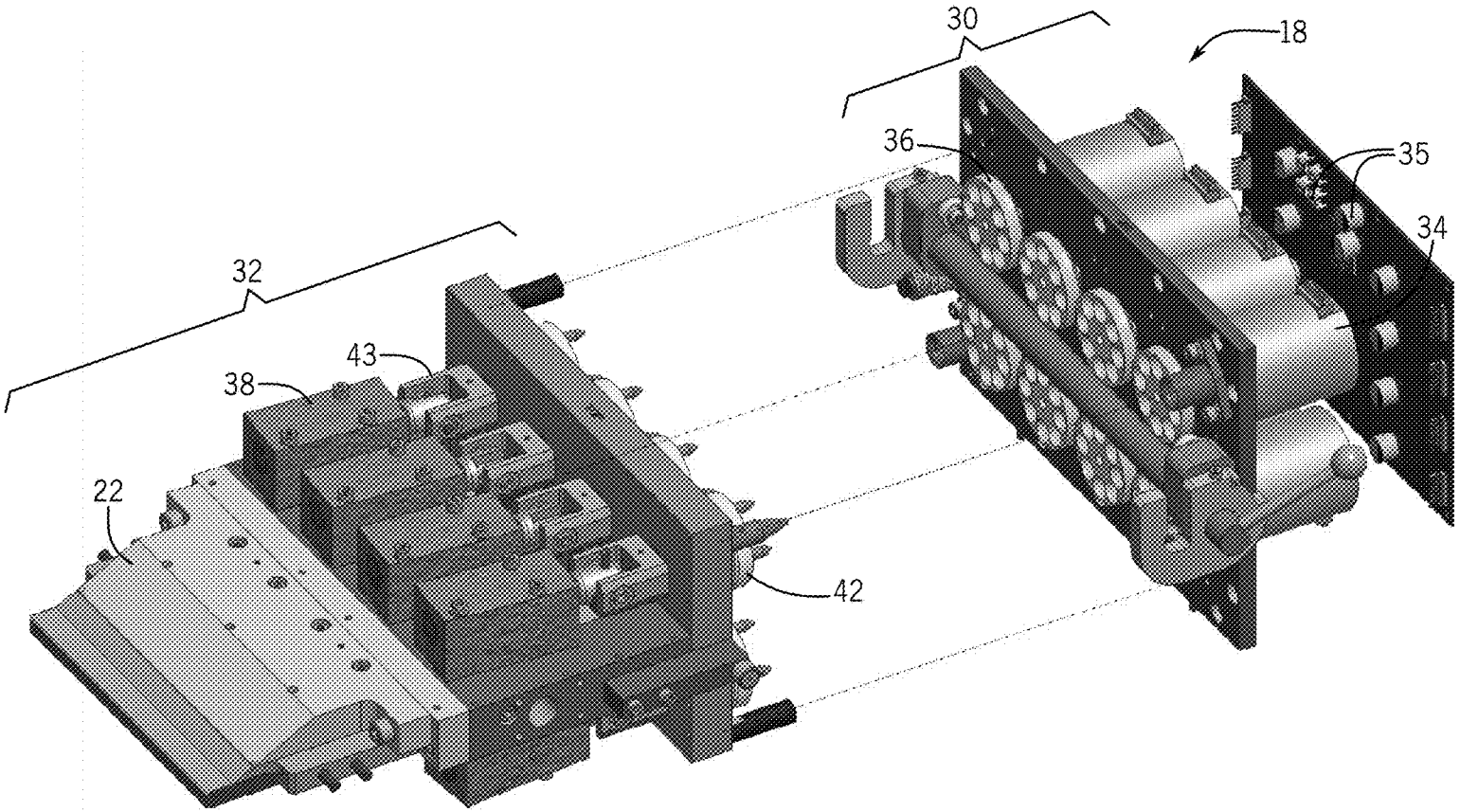
FIG. 2 is a perspective view of an inker's ink distribution module for a decorator press, according to an illustrative embodiment.

Referring now to FIG. 2, a perspective view of ink distribution module 18 will be described, according to an exemplary embodiment. Ink distribution module 18 may comprise a first module 30 and a second module 32. First module 30 may be a motor drive unit and may comprise one or more motors 34, each motor 34 configured to drive an output shaft 36. First module 30 may assemble heavier components into one assembly, while second module 32, which may be a pump unit, may assemble lighter components into a separate assembly. In various embodiments, second module 32 may weigh less than about 30 pounds, less than about 25 pounds, less than about 20 pounds, or other weights. Minimizing the weight of second module 32 may make it easier for a human press operator to move, lift, remove, and/or replace second module 32 from inker 14. In some embodiments, second module 32 of the inker is removable for cleaning while a first module 30 of the inker remains on the press.

In some embodiments, all ink distribution module components that contact the ink are disposed in second module 32.

In some embodiments, first module 30 has no components of inker 14 which contact the ink or which are designed to transfer ink. First module 30 may be free of any ink channels designed to be in communication with ink inlets.

Second module 32 may comprise one or more ink displacement units 38. Ink displacement units 38 may comprise pumps, valves, or other components configured to transfer ink. In one embodiment, ink displacement units 38 comprise positive displacement pumps which are configured for positive displacement pumping of ink. In alternative embodiments, other methods of transferring ink may be used, such as a parasitic pump, a peristaltic pump, a rotary or linear pump, a ball screw drive mechanism, gear pump or other methods of moving fluids. Second module 32 may comprise one or more ink inlets to provide ink to the ink displacement units from a conduit 20 (FIG. 1) coupled to an ink source 16. Second module 32 may further comprise ink channels disposed or defined therein which are configured to transfer ink from ink displacement units 38 to ink outlets of the second module, which may be disposed at inlet or outlet portions of a distribution head 22.

Second module 32 may further comprise input shafts 42 configured to removably couple to output shafts 36 of first module 30. In some embodiments, input shafts 42 may be configured to mechanically self-align by, for example, using a tongue-and-groove arrangement, one or more angled surfaces on the tips of output shafts 36 and/or input shafts 42, or other arrangements, configurations, or attachments. In some embodiments, input shafts 42 and output shafts 36 are configured to magnetically couple, for example in the case where at least one of each pair of shafts comprises a magnet and the other comprises a material attracted to the magnet or magnet of an opposite pole. Any of these mechanisms may comprise means for removably coupling input shafts to output shafts. Input shafts 42 are coupled to transfer linkages 43 which translate movement to ink displacement units 38.

As illustrated, ink distribution module 18 may comprise eight separate sets of motors coupling to ink displacement units 38, while in alternative embodiments, one set, at least four sets, or other numbers of sets may be provided.

Referring again to FIG. 1, inker 14 may comprise at least one support member 44 configured to support the first and second modules in various positions. In FIG. 1, first and second modules are in an operating position in which they may be controlled and sourced with ink to pump and distribute the ink to roller 24. Modules 30, 32 may comprise protrusions or other track riding elements configured to ride on or in support member 44 to allow slidable movement to various other positions.

In an exemplary method, ink distribution module 18 is disengaged from its operating position, slid along the support member 44 to a first retracted position. Second module 32 is then uncoupled from first module 30 and second module 32 is removed by a press operator for cleaning.

In some methods, first module 30 is slid along the support member 44 away from the second module to a first retracted position. This sliding may uncouple the removably coupled input/output shafts 36, 42. Second module 32 is slid along the support member to a second retracted or removal position. These modules may be slid sequentially or simultaneously. Second module 32 is then released from support member 44, for example by an enlarged aperture in a track of support member 44. A press operator may manually remove second module 32 and carry it away for cleaning, for example to a cleaning station remote from the press.

Support member 44 may then receive an alternate second module 32, which has already been cleaned or otherwise contains ink of a different color. The alternate second module may be referred to as a third module comprising ink displacement units configured to be driven by input shafts 36 of first module 30. Third module may have ink displacement units which have been cleaned, are clean, or already contain ink of a different color than the ink displacement units of the second module. In one example, third module may be identical to second module in substantially all other ways. In another example, a plurality of second modules 32 may each be assigned a predetermined color for use with inker 14.

In some embodiments, second module 32 may be formed in whole or in part from molded plastic (e.g., by way of injection molding, blow molding, etc.) Second module 32 may be manufactured using materials providing a low cost (e.g., less than $100, less than $50, less than $20, etc.) to provide a module that is in some cases disposable. The methods described herein may comprise removing second module 32, replacing second module 32 with a third module, which is a clean, replacement module for second module, and disposing of (e.g., recycling) the second module. Second module 32 may be considered a spare part of inker in some embodiments.

Once inserted or aligned on support member 44, the cleaned second module 32 is then slid towards first module 30 until output shafts 36 of the first module couple with input shafts 42 of the second module 32. Either or both of modules 30, 32 may be secured or locked in place using a suitable locking mechanism (e.g., pin and catch, snap fit, detent and recess or groove, latch mechanism, etc.), which may be configured to secure the module to support member 44, to the other module, to both, or to another support arm of inker 14. Ink distribution module 18 may now slide along support member 44 to a normal operating position for inking a roller of the decorator press 10.

In an alternative embodiment, the cleaned second module 32 may be slid along the support member into a position for inking a roller of the decorator press 10. First module 30 may then be slid along support member 44 toward the second module until output shafts 36 of the first module couple with input shafts of the second module. Either or both of modules 30, 32 may be secured or locked in place using a suitable locking mechanism (e.g., pin and catch, snap fit, detent and recess or groove, latch mechanism, etc.), which may be configured to secure the module to support member 44, to the other module, to both, or to another support arm of inker 14.

As illustrated, in at least one position relative to roller 24, support member 44 is configured to facilitate removal of second module 32 by a press operator for cleaning the ink channels. While a support member for sliding movement is shown in this exemplary embodiment, other types of movement structures may be used, such as a swing arm assembly, etc.

As shown, a combined ink distribution module 18 of independent, but separable modules 30 and 32 may be mounted to rails that attach to the decorator press.

In some embodiments, first module 30 may be a motor section or side, separated from second module 32 which may be an ink pumping section. These two sections may tie together during production operation, but can easily separate for cleaning and color change. The combined unit may be mounted to rails that attach to a decorator press. When there is a color change, the combined unit may slide back on the rails, the sections may separate through a latching mechanism and then the ink pumping section may be removed and easily replaced with a different, clean ink pumping section. The used ink pumping section can be cleaned if necessary after the press is up and running again.

First module 30 may be a power pack and second module 32 may comprise a distribution head, wherein the combined package of both modules may weigh at least 40-50 pounds, or more.

Figure 3:
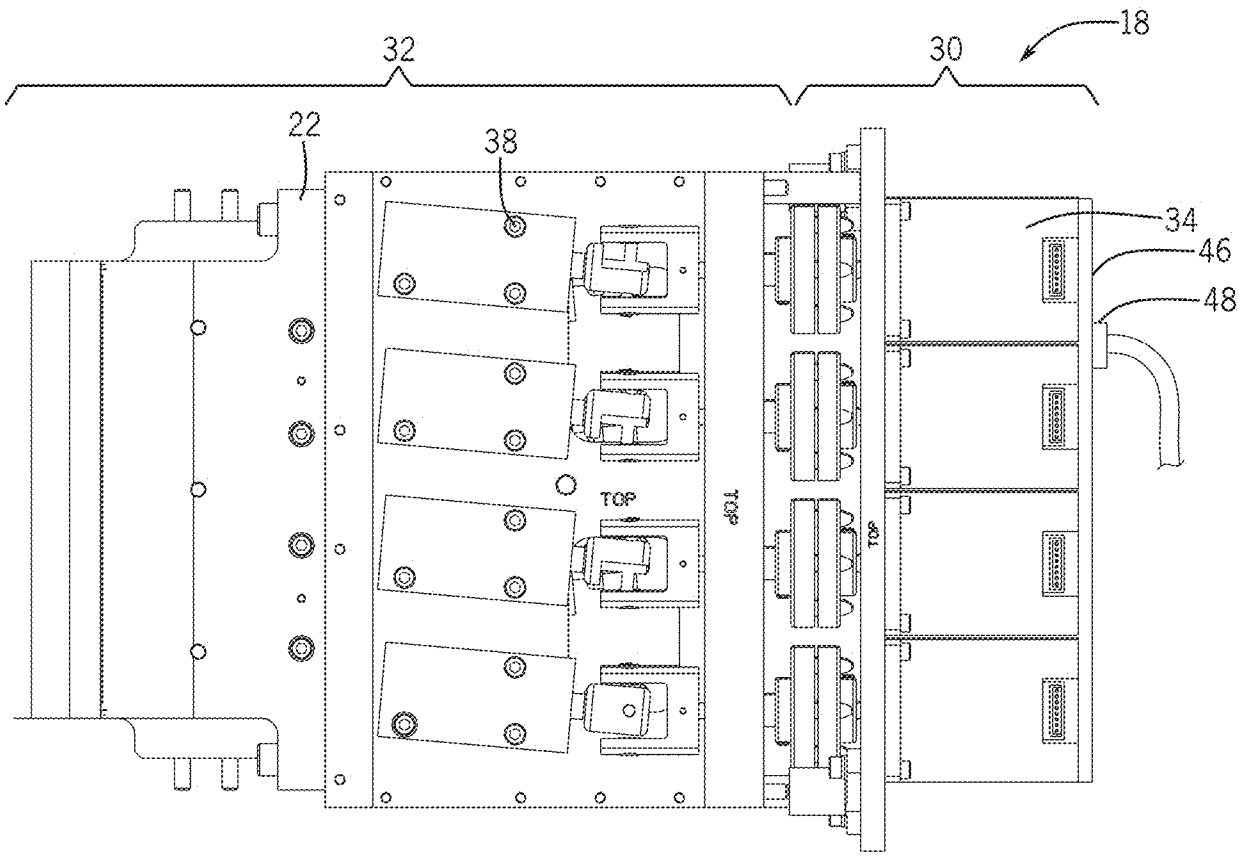
FIG. 3 is a top view of an inker's ink distribution module, according to an illustrative embodiment.

Referring now to FIG. 3, a top view of ink distribution module 18 is shown, according to an exemplary embodiment. In this view, a circuit board 46 is shown coupled electrically and mechanically to motors 34. Circuit board 46 is part of first module 30 and comprises electrical components 35 (FIG. 2) configured to power the motors at different speeds based on control signals received at a control input port 48 via wired or wireless communication link to a remote control unit.

Figure 4:
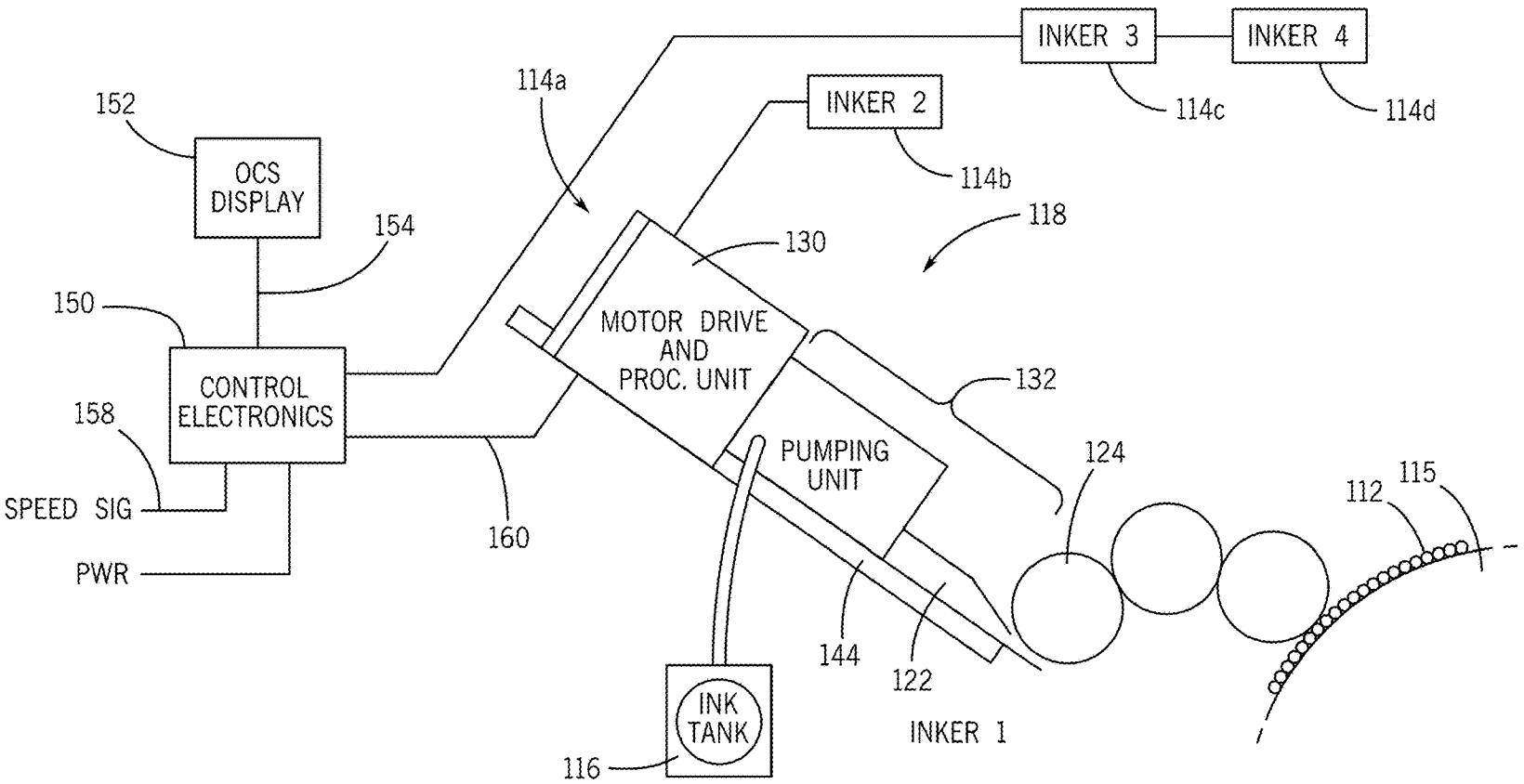
FIG. 4 is a block diagram of a control system of the digital inking system for a decorator press, according to an illustrative embodiment.

Referring now to FIG. 4, a block diagram of a digital inking system will be described, according to an exemplary embodiment. Power enclosure 150 may comprise a processing circuit configured to drive or control the various elements of the digital inking system. Power enclosure 150 may be configured to communicate via a line 154 with a user interface display 152. Ink volume settings received from user interface display 152 are transferred via communication line 154 to the power enclosure 150. Communication line 154 may comprise a wired or wireless interface (e.g., Ethernet, etc.). Power enclosure 150 may be configured to receive a speed signal 158 from the printing press representative of the speed at which the printing press is operating. For example, a faster speed as indicated by the speed signal 158 will cause the ink distribution module 118 to distribute ink at a faster rate.

Power enclosure 150 may be configured to communicate via line 160, which may use wired or wireless communication with a first module 130. Module 130 comprises motors, drive electronics, processing electronics, etc. First module 130 receives the ink volume settings and press speed signal and processes them to determine the rate at which to drive the motors which are connected to the output shafts, which in turn are connected to the input shafts of second module 132. Second module 132 may comprise displacement units configured to provide the ink to a distribution header portion 122 for disposition on roller 124. The ink travels across the roller train and is applied to a plate cylinder and then to cans 112 which are moved through the printing press by conveyor 115. As shown, power enclosure 150 may be configured to communicate to a plurality of ink distribution modules 114*a*, 114*b*, 114*c* and 114*d* to provide ink of different colors at the proper pumped rate or rates based on the speed signal 158 and ink volume settings received from user interface 152.

In alternative embodiments, the processing of the various inputs may be provided at different control units within the system, such as at power enclosure 150, OCS display 152, or other control units.

Modules 130 and 132 may be combined together and slid into place on rails 144, the rails configured to set the correct distance relative to roller 124 via a stop mechanism such as gauge blocks. Modules 130 and 132 may be secured or locked into place.

When a label run is complete and a new label change is required, the securing mechanisms securing the modules to one another and/or to rails 144 may be unlocked, modules 130 and 132 may be slid away from roller 124, and module 132 may be removed from the rails or other support mechanism and replaced with a clean module. The clean module may be combined with module 130 and slid back towards roller 124 along rails 144. Gauge blocks may ensure that the combined ink distribution module 118 will be disposed at the correct location or gap relative to roller 124 (e.g., gap between a blade of distribution head portion 122 and roller 124). One or both of modules 130 and 132 may then be securely locked into place. This process may be repeated for other ink distribution modules 114*b*, 114*c*, 114*d*, as needed to make a label change.

In some embodiments, the distribution head portion 122 is configured to have a gap between the roller 124 and face of the distribution head through which ink comes out at a thickness of about 0.015 inches.

Figure 5:
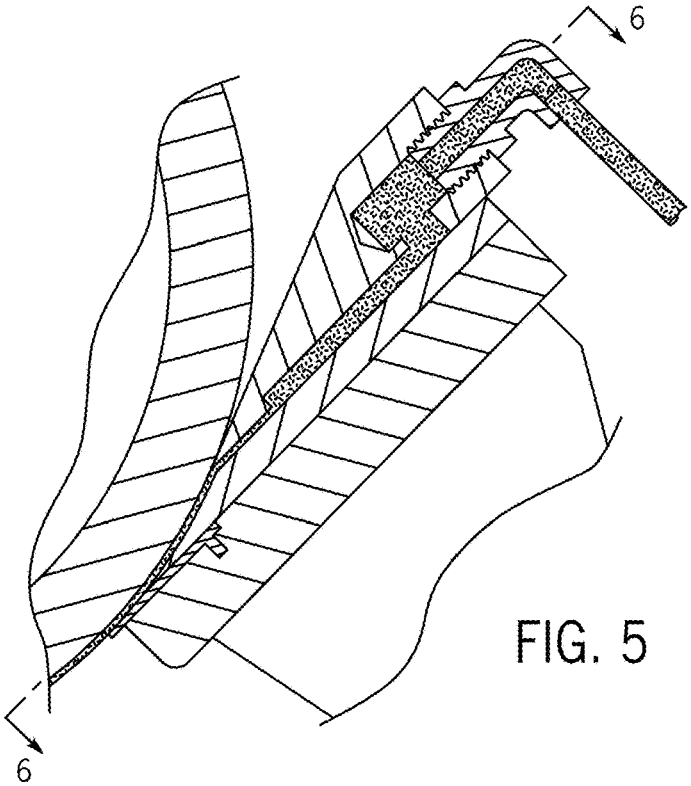
FIG. 5 is a vertical sectional view of one inkjector of a distribution head, according to an illustrative embodiment.
Figure 6:
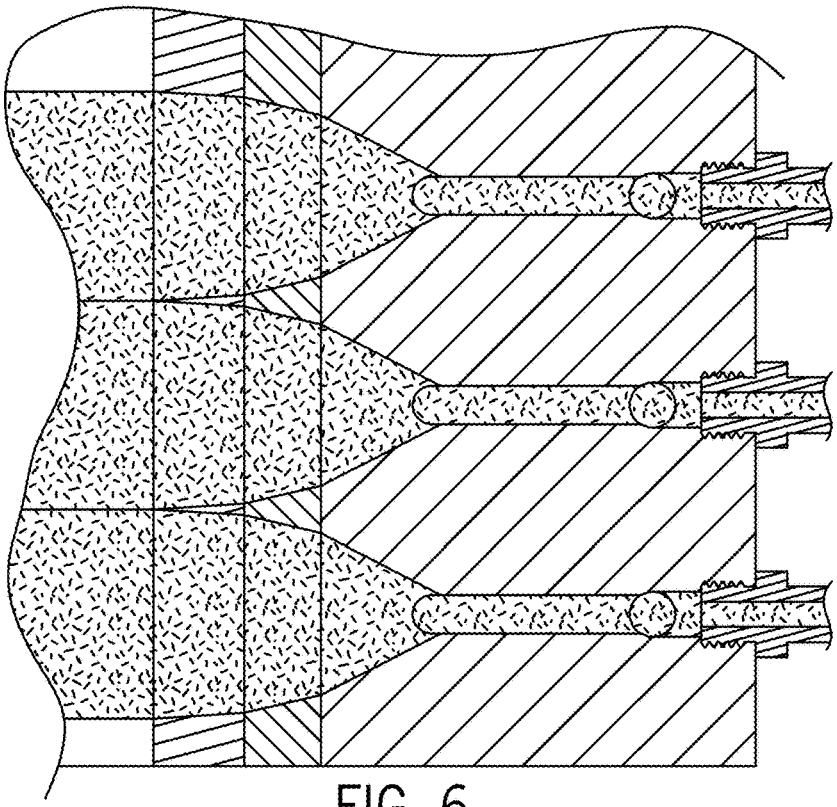
FIG. 6 is a view taken along lines 6-6 of FIG. 5 and showing several of the ink patterns made by the ink distributors, according to an illustrative embodiment.
Figure 7:
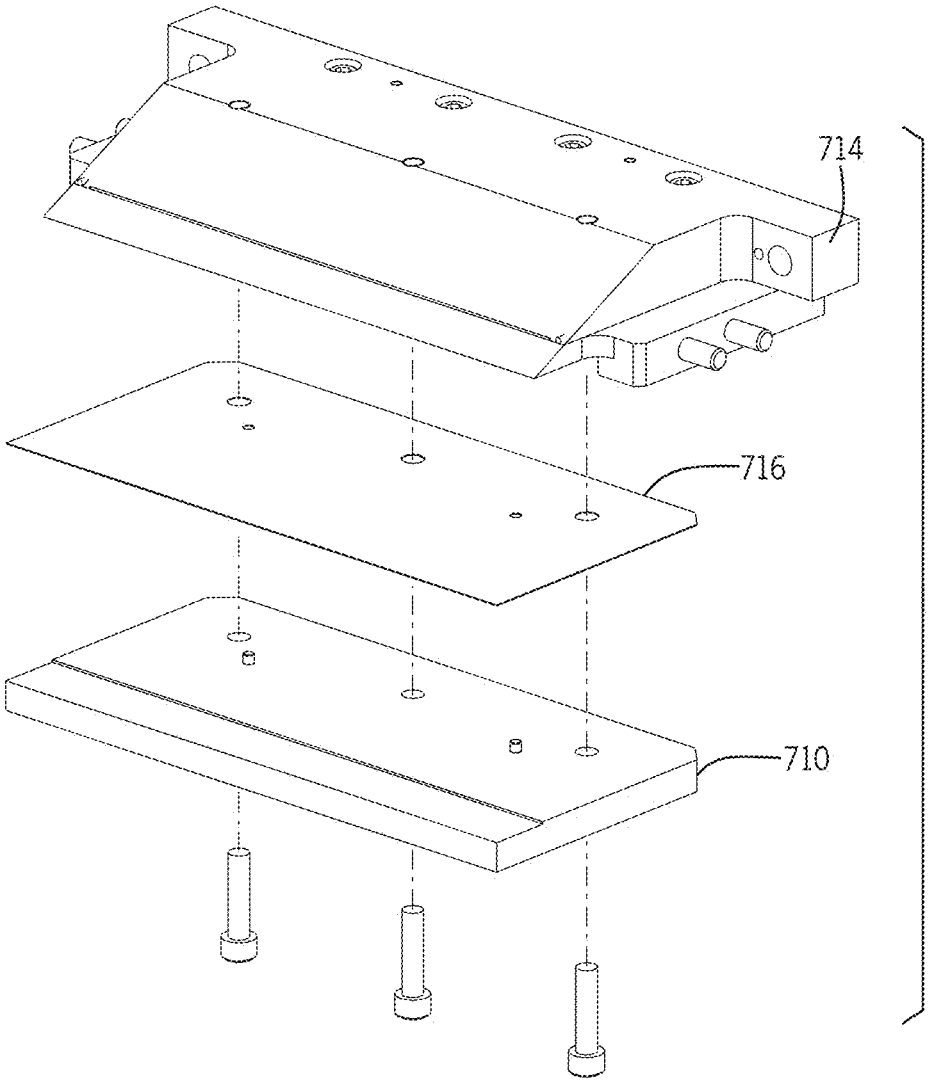
FIG. 7 is an exploded view of a distribution head showing a blade, according to an illustrative embodiment.
Figure 8:
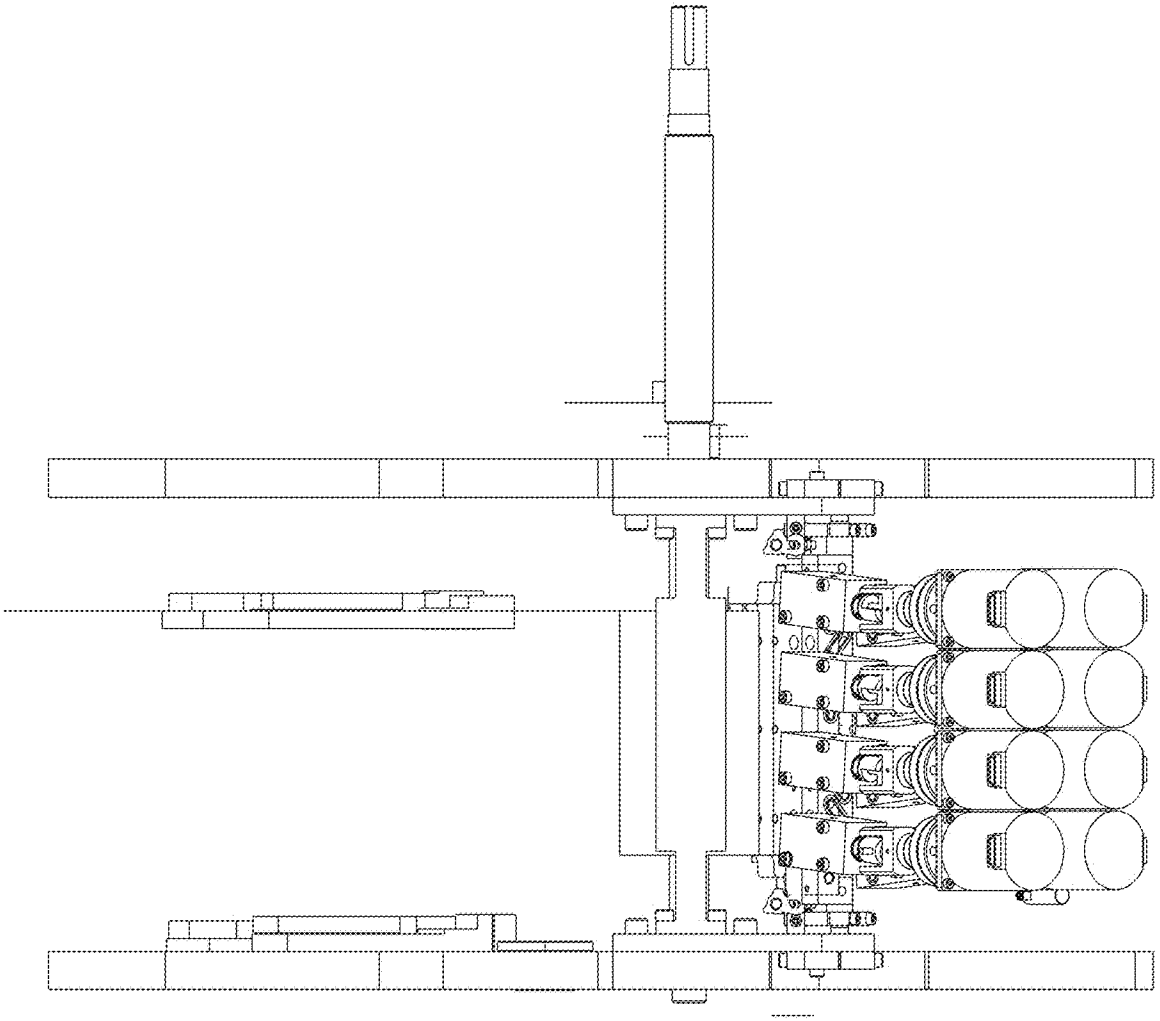
FIGS. 8 through 12 are views from other angles of the inker's ink distribution module shown in FIG. 1, according to an illustrative embodiment.
Figure 9:
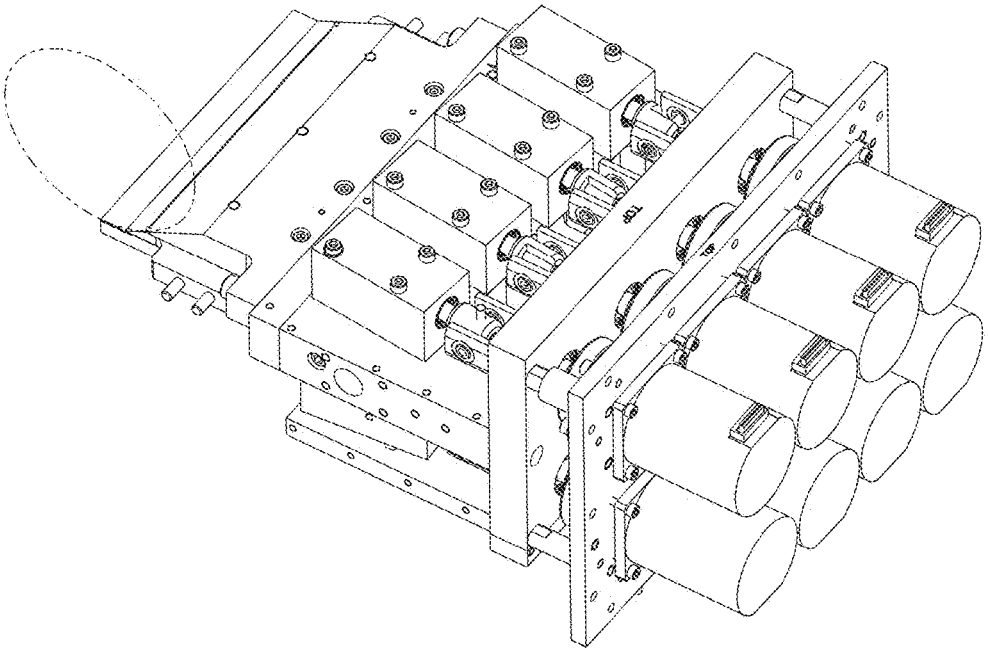
Figure 10:
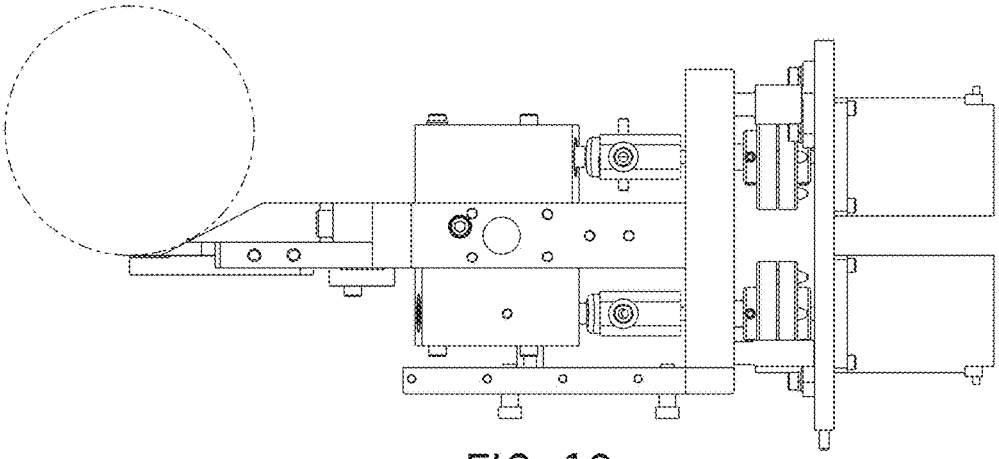
Figure 11:
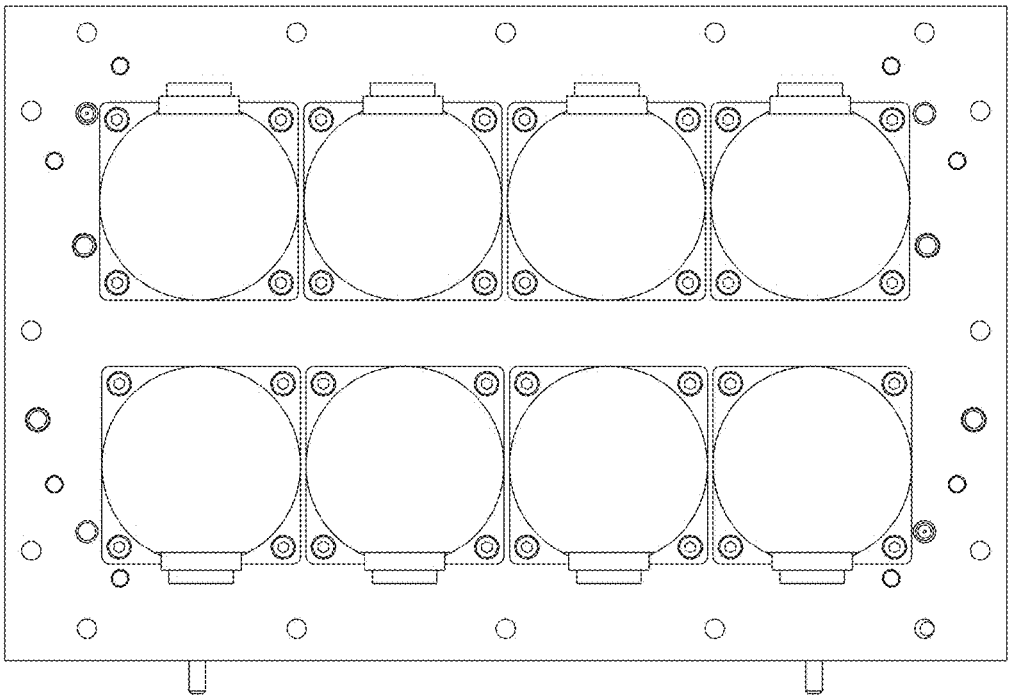
Figure 12:
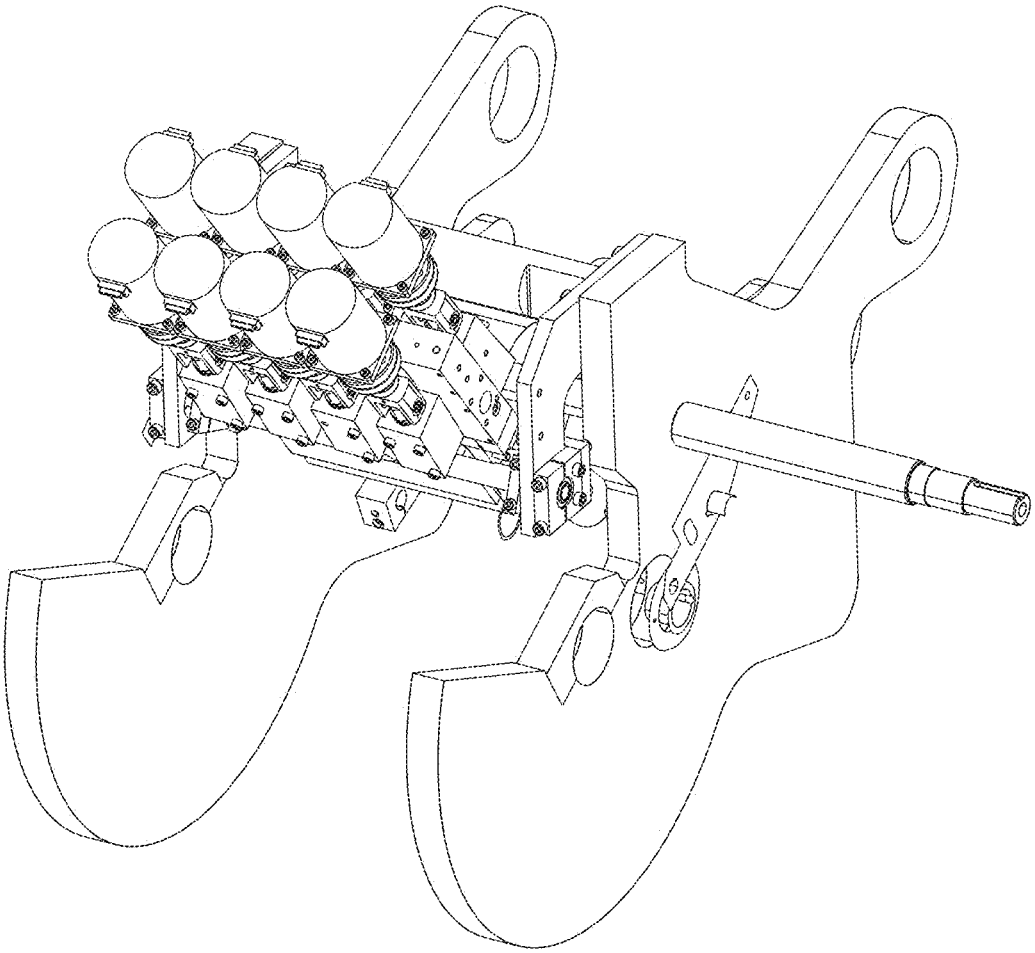

By referring to FIGS. 5 through 7, the operation of an exemplary distribution head portion of the second module can be more clearly viewed, though distribution heads of a variety of different configurations may be implemented. The ink is shown to be spread from its region of concentration to an area in which it is dispersed, finally reaching a tangent point to that of an adjacent discharge. The blade does not move in this embodiment, but serves to spread or transfer the ink evenly, to the extent this has not been done already.

With the pumps set to self-adjust to the new ink flow requirement on a column-by-column basis, this may occur constantly as press speed varies. Press speed information is "broadcast" to each ink distribution module, allowing adjustments to be made providing improved accuracy. In a condition where little or no ink is required, the blade is still maintained at a constant distance from the roller, but the pump supplies no ink and consequently, the zone is empty.

In one embodiment, there may be no physical or mechanical connection between the press and the digital ink supply system. In alternate embodiments, one or more components of the digital ink supply system may be coupled to components of the press, such as a housing or mounting bracket.

All adjustments, such as the amount of ink that is applied to the roller and transferred to the can, may be made from a keyboard or console.

Control of ink put on the cans may be achieved volumetrically. In one embodiment, the digital inking system may add a certain, fixed amount of ink with each revolution of the roller.

The digital inking system may be retrofitted to existing presses, for example, for a press which is equipped with an ink fountain or similar type arrangement.

In some embodiments, there may be one of these ink distribution modules for every color of ink used in the press. This could be advantageous in a four, five or six color press.

In various embodiments, a keyboard can be placed next to the digital inking system, or it can be centralized at a console. The option of having both the keyboard and a console offers options in press ink and water control. In various embodiments, a centralized user interface may be placed in close vicinity to the digital inking system.

Regarding options available with the system, it is possible to allow the console to measure ink usage. In fact, this may be done all the way down to the per column level. This makes it possible to track consumables down to a fine degree.

The keyboards may be "smart" and may remember their last settings. Accordingly, if there is a power failure, the correct settings will not be affected. The digital inking system can work with pre-press image files or can recall previous settings that were saved. If there is a power failure, the settings can simply be recalled.

As described, FIG. 1 illustrates an exemplary ink distribution module 18 mounted on rails 44. The ink distribution module is mounted such that the distribution head portion 22 is at a predetermined angle and distance from roller 24. The ink distribution module 18 can be slid back to simplify cleaning or removing of second module 32. The press has a roller 24 that is inked by the distribution head portion 22 of second module 32. Second module 32 receives ink from the ink source 16 which then pumps ink out through the distribution head portion 22 onto roller 24.

In FIG. 7, the distribution head is shown detached from second module 32 and in an exploded view. It is made up of a base part 710, a wiper blade 716 and an angled top part 714. Blade 716 is disposed within a small gap of roller 24 of FIG. 1 and provides a controlled ink film thickness to roller 24.

FIGS. 8 through 12 illustrate the ink distribution module of FIG. 1 in various alternative views, according to an exemplary embodiment.

While eight ports are illustrated in the exemplary embodiments herein, the number of ports may be variable in width and position, i.e. 6 ports, 8 ports, 10 ports, etc. In one embodiment, a frame or track may be used to mount 1, 2, 4, 6, 8, etc., ports in fixed or variable positions to make the arrangement configurable for different size press arrangements.

Referring to FIG. 2, variable angular alignment between the pistons/barrel blocks 38 and yoke assembly 43 provide the capability to adjust the flow capacity by varying the stroke length of the piston assembly.

Figure 13:
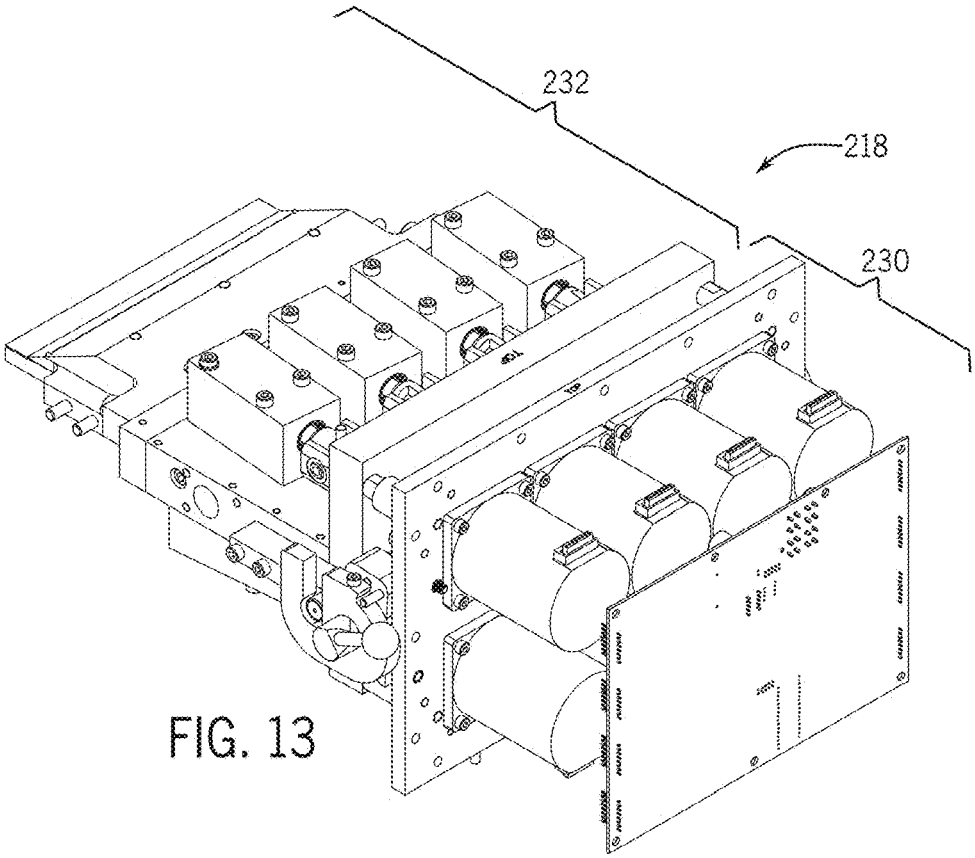
FIG. 13 is a perspective view of an ink distribution module with a latch mechanism, according to an exemplary embodiment.
Figure 14:
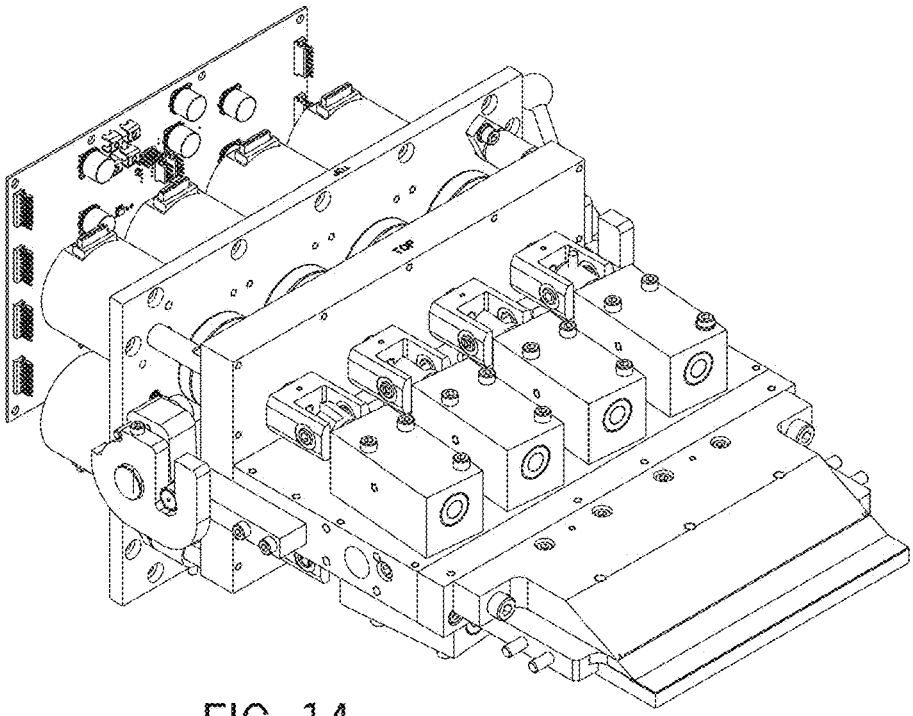
FIG. 14 is a perspective view of the ink distribution module with latch mechanism of FIG. 13, according to an exemplary embodiment.
Figure 15:
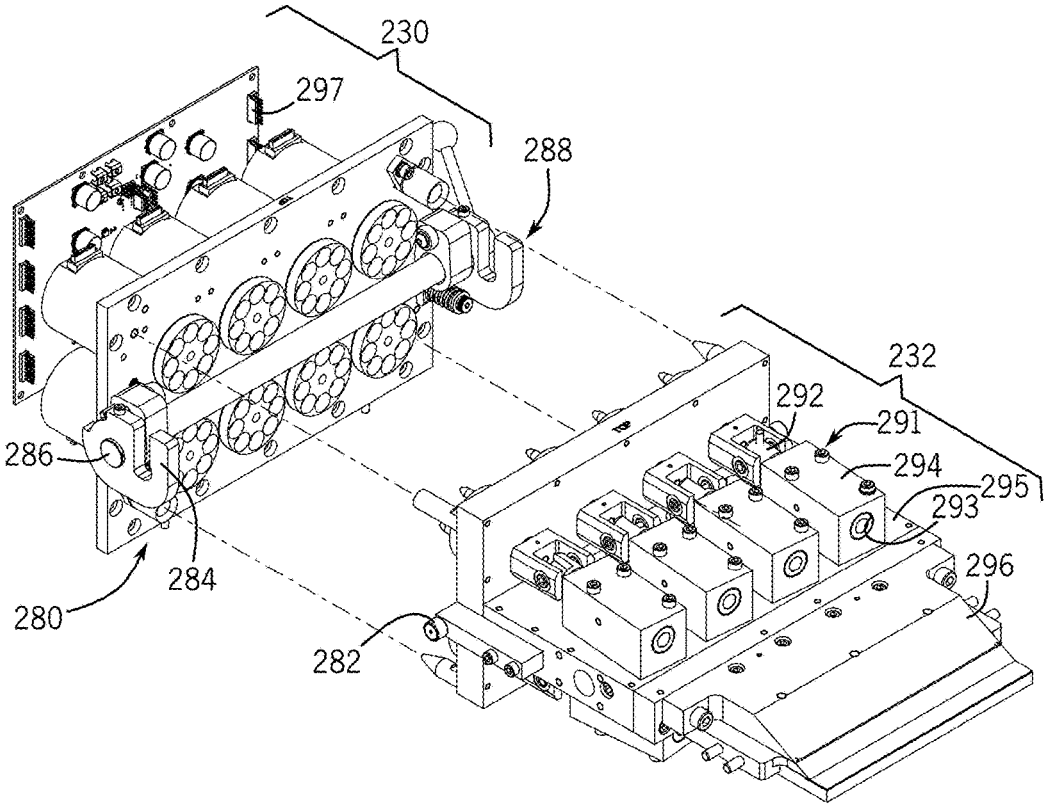
FIG. 15 is a perspective view of the ink distribution module with latch mechanism of FIG. 13, according to an exemplary embodiment.

In some embodiments, the alignment between the ink distribution module (specifically the distribution head portion) and roller 24 can be set via gage blocks or can be done automatically through positional sensors and/or linear actuators. Referring now to FIGS. 13-15, an ink distribution module is shown, according to an exemplary embodiment. In this embodiment, ink distribution module 218 comprises a first module 230 and a second module 232. Modules 230 and 232 are joined by a latch mechanism. As shown in FIG. 15, latch mechanism comprises first and second components, which may be mounted on either module 230, 232 and at a variety of surfaces thereon. In this example, catch 282 is mounted on module 232 and hook portion 284 is mounted on module 230. Hook portion 284 comprises a hooking surface configured to engage and pull toward itself catch 282. The engagement and pulling motion occurs in response to a human press operator twisting a knob or lever 286 or, in alternative embodiments, pressing a button. A second latch mechanism 288 may be employed on an opposite side of modules 230, 232 from the first latch mechanism, or on other surfaces. Additional latch mechanisms may be provided. In this embodiment, the latch mechanisms are hand-operable by a human press operator; they may be hand-operable without requiring the use of tools.

Figure 16:
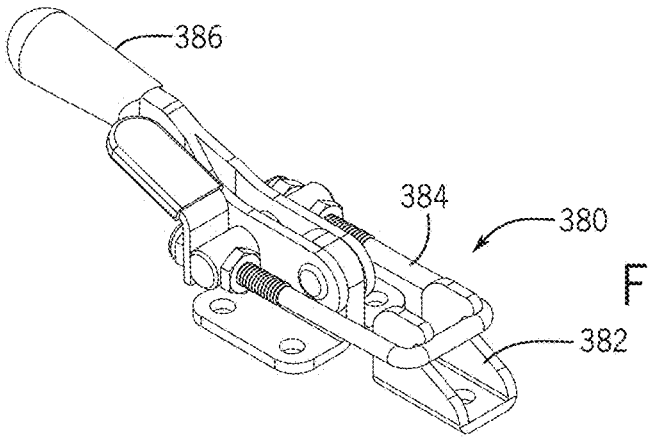
FIG. 16 through FIG. 20 are perspective views of various latch mechanisms, according to exemplary embodiments.

FIG. 16 illustrates an alternative type of latch mechanism to couple two members together, in which the members may be the first and second modules, a module and a support member, or a module and another part of the inker or press. A toggle damp 380 comprises a catch 382 or hooked portion coupled to one member and a loop 384 coupled to another member. Loop 384 may be operable by a lever 386 by lifting the lever to loosen the loop 384, then swinging the loosened loop away from catch 382. To latch the toggle clamp 380, the loop is manually set around catch 382, then the lever 386 is pressed downward to tighten. A user may pull the handle 386 back to engage the draw arm 384. The length of the draw arm 384 may be adjustable.

Figure 17:
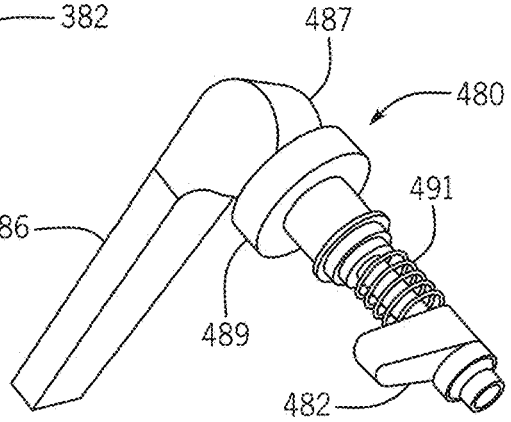

FIG. 17 illustrates another alternative type of latch mechanism. Latch mechanism 480 is a cam latch. A lever 486 comprises a cam portion 487 which moves against a base 489. Base 489 is coupled to one member and a mounting piece 482 is coupled to another member. Lever 486 is coupled to a pin 491 which can move out of or into contact with mounting piece 482 to easily latch or release one member to another.

Figure 18:
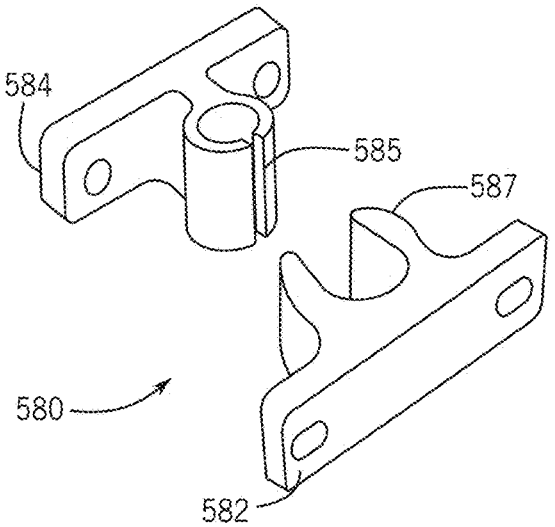

FIG. 18 illustrates another alternative type of latch mechanism. A grab latch 580 comprises a first piece 584 mounted to a first member and a second piece 582 mounted to a second member. First piece 584 comprises a protrusion 585 configured to receive a C-shaped portion 587 of second piece 582 in a snap-fit arrangement. C-shaped portion 587 may comprise a pliable material configured to open slightly and receive protrusion 585 to latch first piece 584 to second piece 582. This latch mechanism may also be operable by a human press operator by pulling apart the two members being coupled thereby.

Figure 19:
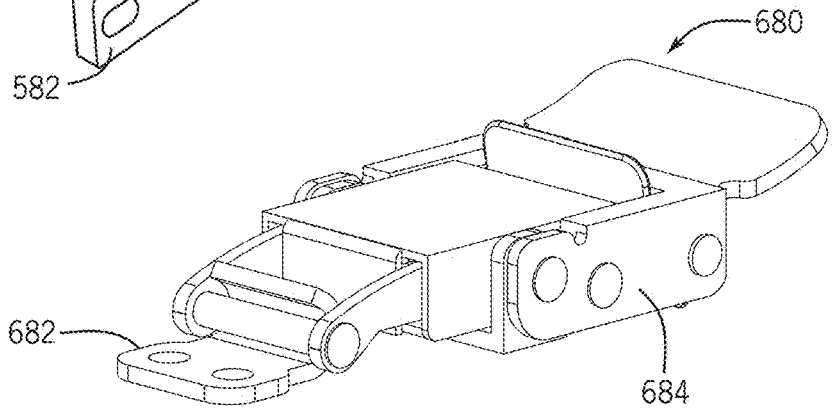

FIG. 19 illustrates another alternative type of latch mechanism. This latch is a spring tension draw latch 680. When the latch is fully closed, compression springs provide constant holding tension for secure latching. The springs begin compressing when the latch engages the strike and continue compressing until the latch closes. The two portions 684 and 682 can be mounted to respective members and can draw the two members together.

Figure 20:
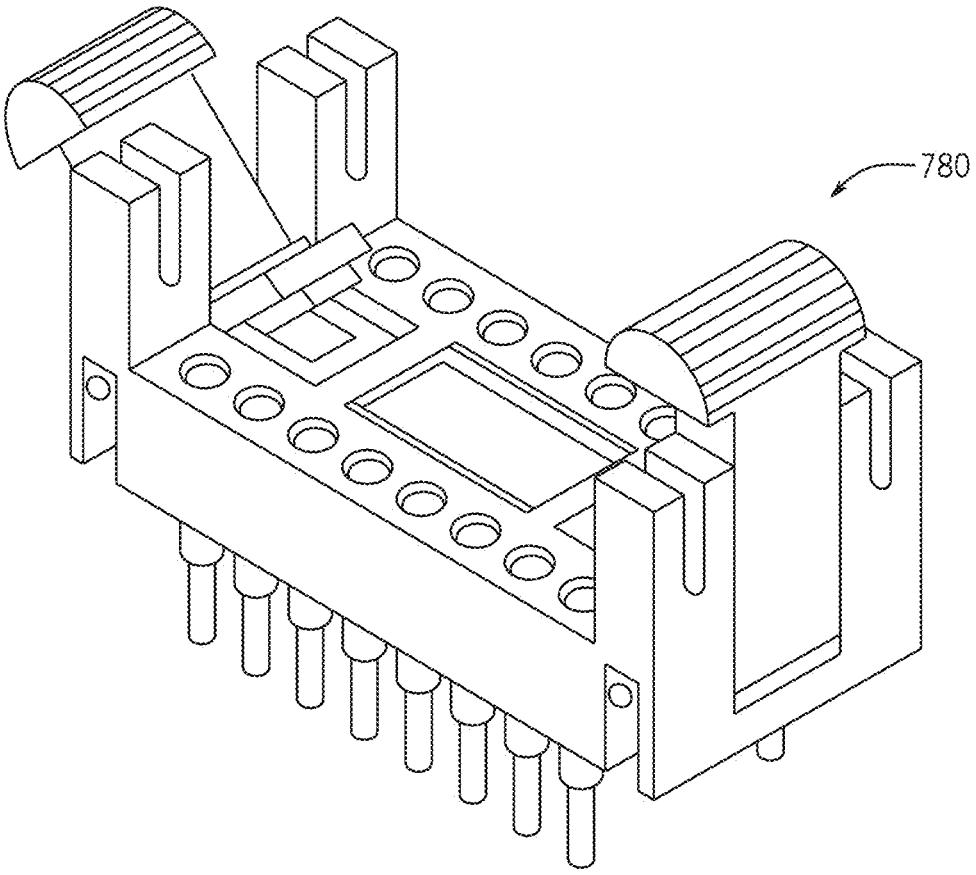

FIG. 20 illustrates another alternative type of latch mechanism. This latch may comprise a self-ejecting latch 780. The self-ejecting latch 780 may have a cam feature that would separate the two members when rotated to be opened or disengaged. Each member may have a cam feature mounted thereto. The two cam features may be rigidly connected to each other to operate simultaneously, with one handle. These cam features may be attached to the pump section (front half) and the handle could be used to lift the unit from the decorator.

Any of the latch mechanisms described herein may comprise means for removably coupling first and second modules to one another, or to other components. While a decorator press for printing on cans is described in the exemplary embodiments herein, the teachings herein may be applied to other printers (e.g., digital printers, web offset printers, flexographic, special colors on web offset printers, etc.) which print on other substrates (e.g., non-metal products, paper, cardboard, plastic bottles, etc.).

Referring to FIG. 4, in some embodiments, an automated back-out system may be deployed. When a first can requires a first set of colors and a second can requires a second, different set of colors, certain ink distribution modules are to be cleaned or replaced between label runs. Each ink distribution module 114*a*, 114*b*, 114*c* and/or 114*d* may comprise a drive mechanism or other actuator configured to move module 130 and/or module 132 away from respective rollers 124 in response to control signals from power enclosure 150, OCS display 152, or another control circuit. Upon completion of a label run, either manually in response to a press operator pressing a button on OCS 152 or automatically upon detection of completion of the label run, a control circuit may be configured to command the drive mechanism(s) of certain of ink distribution of modules 114*a*, 114*b*, 114*c* and/or 114*d* to move modules 130 and/or 132 away from rollers 124 into a position wherein they can be cleaned and/or removed from rails 144 or other support mechanisms. The control circuit may be configured to remotely control actuation and/or deactuation of any latch mechanisms latching modules 130 and 132 to one another and/or to rails 144 or other support mechanisms. When modules 130 and/or 132 are in a retracted position, module 132 may be removed for cleaning and/or replacement.

In some embodiments, a motorized drive mechanism is not required to remotely and automatically move modules 130 and/or 132 away from rollers 124. For example, gas struts, springs, or other devices for storing and/or providing mechanical energy may be used along with a latch that is controlled by an actuator. When the actuator unlatches the latch, mechanical energy is released to move the modules 130 and/or 132 away from rollers 124.

In one example, only a subset of all of ink distribution modules 114*a*-114*d* are retracted during the automated back-out process. For example, if a first label requires red, black and white inkers and a second label requires red, green and yellow inkers, the black inker and white inker may be retracted to be replaced with pumping modules for green ink and yellow ink. The red inker may remain in a deployed or forward position.

In one example, OCS display may be configured to display indications of each of the inkers 114*a*-114*d* available on the decorator press. The indications may be user input devices which are selectable (e.g., via touch screen, using a mouse, etc.) and/or toggleable to indicate a command to retract the ink distribution module at the end of a label run. The end of the label may be indicated by the press operator selecting another user input device, which acts as a command to retract all inkers previously selected for retraction. In this manner, a subset or all of the inkers may be automatically retracted using a control system and motorized drive mechanisms.

Referring now to FIG. 15, a piston error detection system will be described. In a positive displacement pump 291, a piston 292 rotates within a cylindrical wall 293 of a cylinder or piston block 294. Due to the manufacture of the piston, ink or other fluid is controllably drawn from a billet 295 and pumped through to a distribution head 296. In some circumstances (e.g., ink thickness, temperature, humidity, etc.), the force required to rotate piston 292 is insufficient to overcome a force of friction between an outer surface/wall of piston 292 and the inner surface/wall 293 of cylinder block 294. In this case, piston 292 stops rotating, while other pistons on the same ink distribution module may continue rotating. This can lead to inadequate inking and other drawbacks.

A piston error detection system may comprise a sensor 297 configured to detect movement of piston 292, which may further detect piston 292 stalling, stopping, jamming, or otherwise having an error. Sensor 297 may comprise a circuit component (e.g., a monitored resistor, etc.) configured to detect an increase in motor current beyond a predetermined threshold which can be indicative of a piston error. Alternatively, sensor 297 may use light, such as using an encoder, to detect speed of sensor dropping below a predetermined threshold, or other sensing technologies, to detect a piston error or stoppage.

In response to detecting a piston error, sensor 297 may be configured to send a signal to an indicator, local or remote, to alert a press operator to the condition. In one embodiment, the indicator may be a light indicator and/or accompanying sound indicator (e.g., via a speaker) disposed on module 230 at the location of the motor being monitored. For example, module 230 and/or module 232 may comprise eight sensors and associated indicator lights each in the vicinity of a respective piston block to direct a press operator visually to the piston experiencing the error. In another embodiment, a communication circuit may be coupled to sensor(s) 297 and configured to transmit data about the piston error to OCS display or another display and/or speaker remote from (e.g., at a nearby press control module, in another room, etc.) modules 230 and 232. The communication may be over a wired cable and/or over a wireless communication (e.g., via Bluetooth, Wi-Fi, ZigBee, or other wireless technology). In one embodiment, the data about the piston error may comprise data identifying the piston experiencing the error, such as inker 1, motor 3. A control circuit may be configured to associate an error detected by sensor 297 with a piston and to transmit data indicative of the piston location in coded form.

Figure 21:
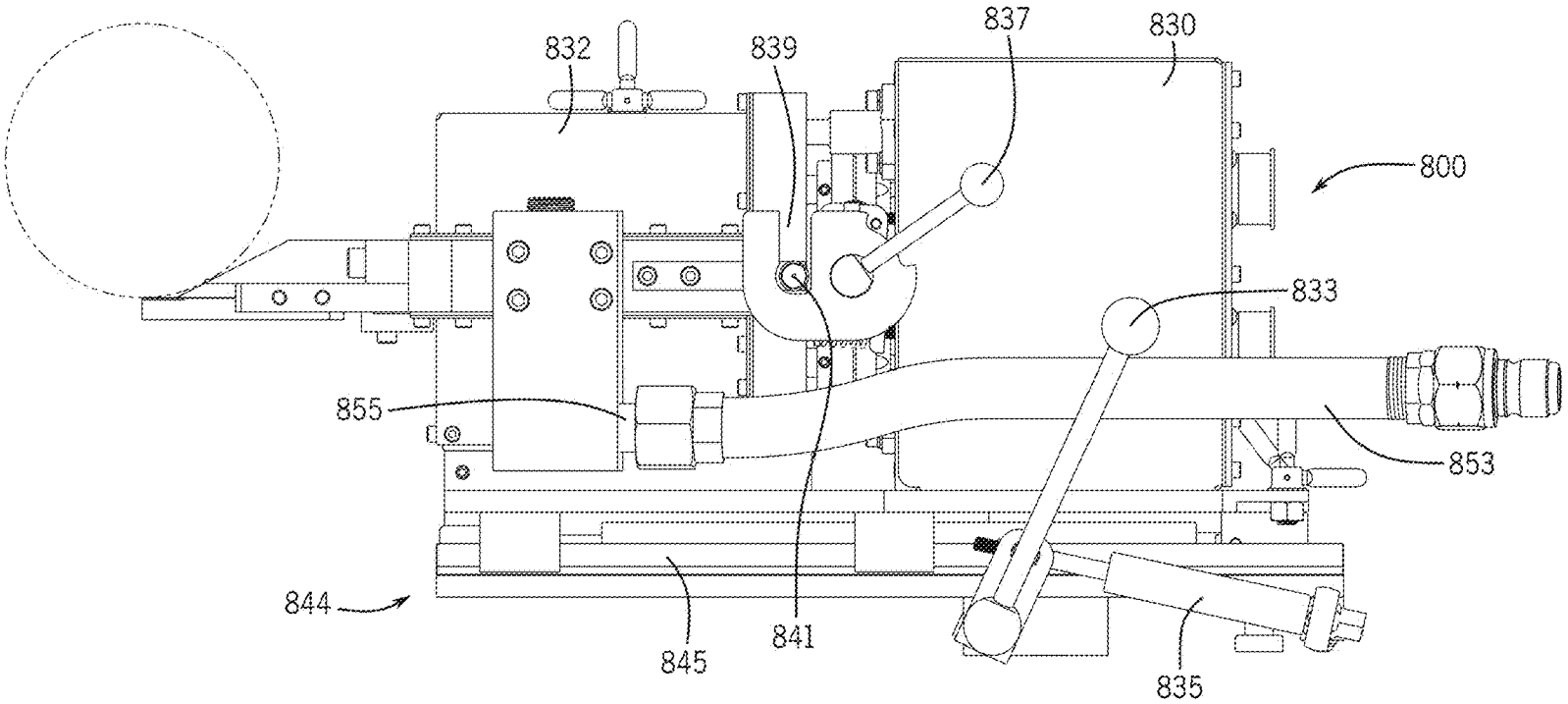
FIGS. 21 through 24 are drawings of an ink distribution module, according to another embodiment.

FIG. 21 is a set of drawings of an ink distribution module 800, according to another embodiment. Ink distribution module 800 comprises a first module 830 and a second module 832 with features similar to corresponding modules described hereinabove. Modules 830 and 832 are slidable along support member 844 from a forward or deployed position to a retractable position. To move modules 830 and 832 to the retracted position, a person pulls on handle 833 which is coupled to a base plate that is slidable along tracks 845. Handle 833 works against a gas strut 835 which is fixed to a base. Once modules 830 and 832 are retracted, a second handle 837 is manually actuated in a rotational manner to release module 832 from module 830 by a groove 839 releasing a pin 841. Module 832, which may be relatively lighter than module 830, can then be manually removed from support member 844 and taken to an area for cleaning and/or disposal. In an alternative embodiment, a hex wrench may be used on a hex bolt instead of handle 833.

FIG. 21 also illustrates an ink inlet tube 853 feeding to an inlet port 855 of module 832.

Figure 22:
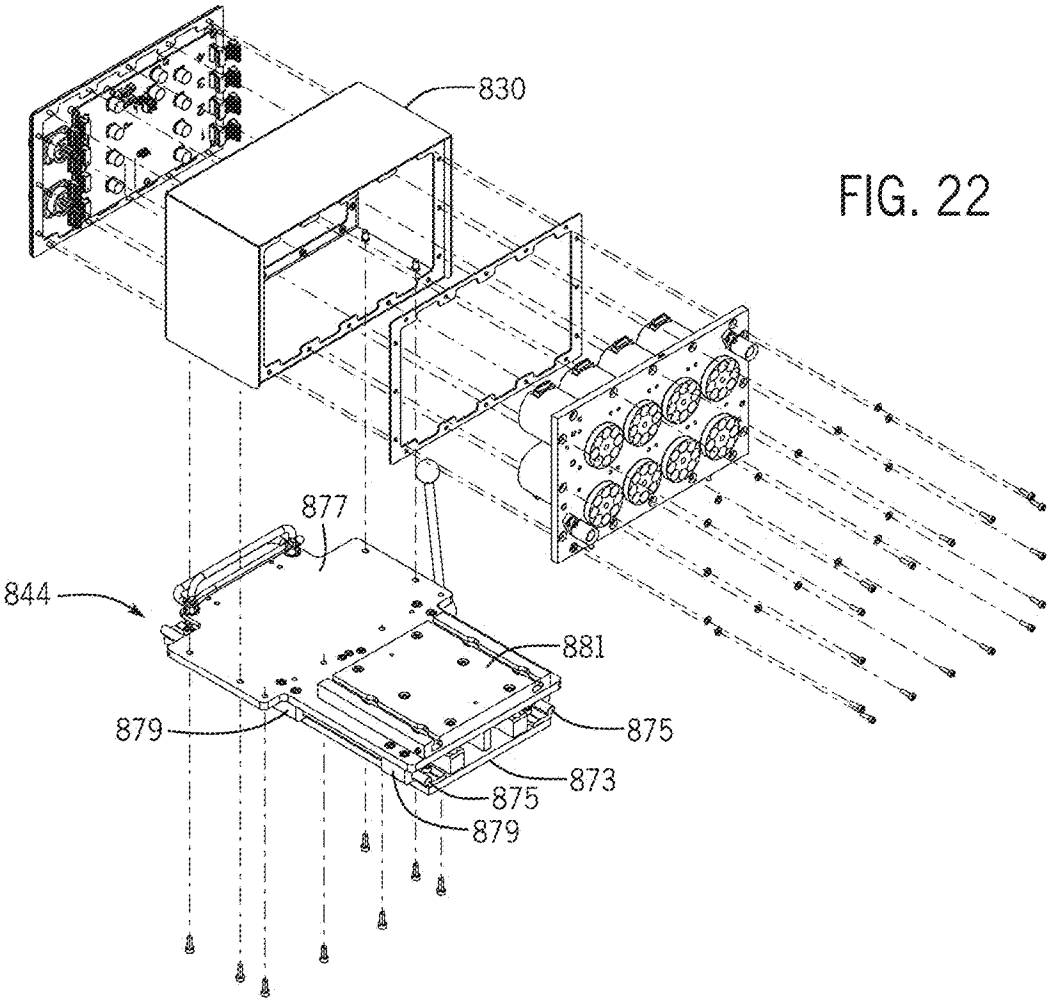

FIG. 22 is an exploded view of module 830 coupled to support member 844. Support member 844 comprises a base plate 873 having mounting rails 875 and a sliding plate 877 having guides 879 that guide sliding plate 877 along rails 875. A second plate 881 is fixed to plate 877 with fasteners, such as screws. Plate 881 has slots defined therein to allow a second module (not shown) to slide forward from module 830 when unlatched.

Figure 23:
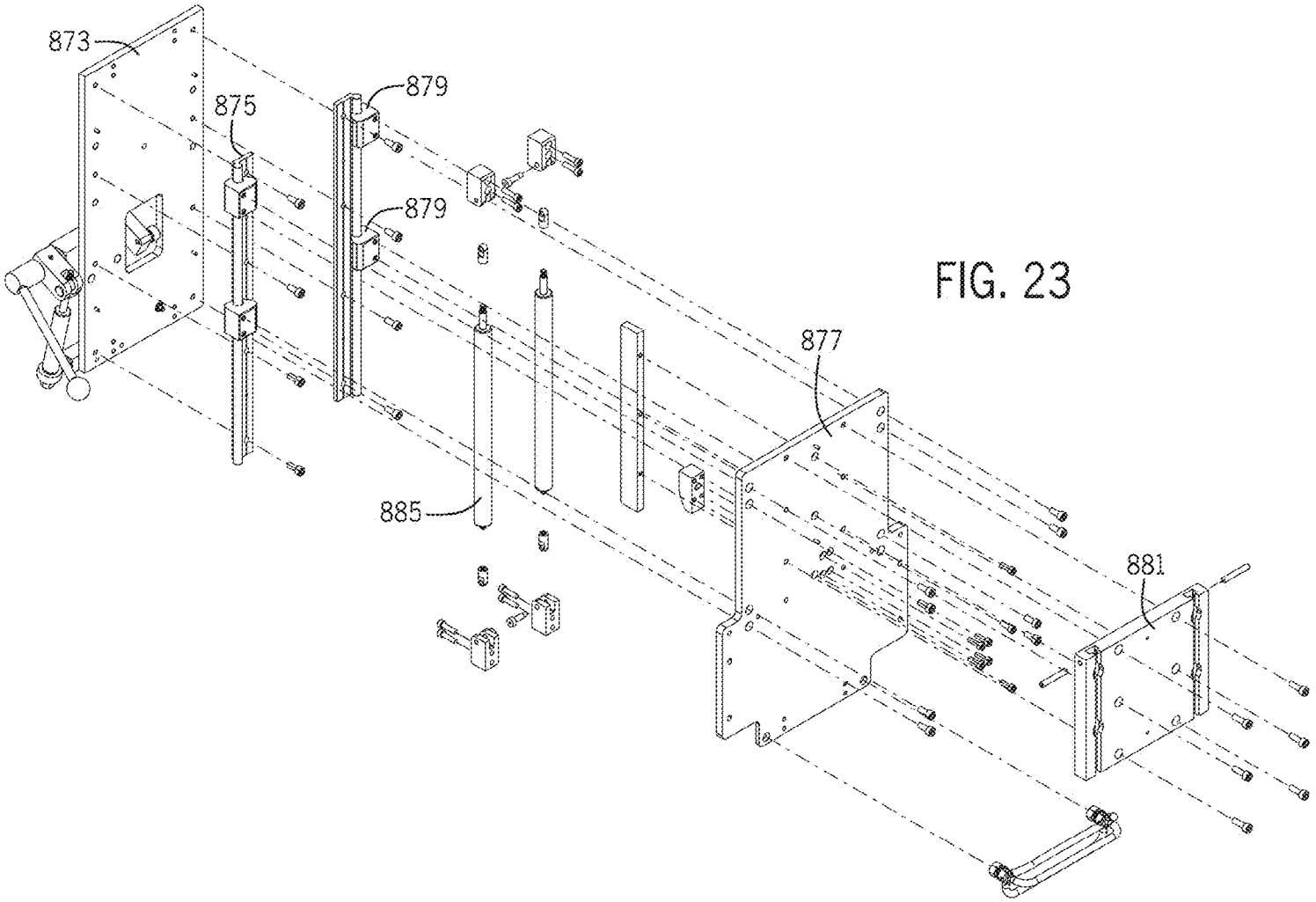

FIG. 23 is an exploded view of support member 844. Base plate 873 is fixed to rails 875. Guides 879 are fixed to top, sliding plate 877 which is fixed to first module 830. Gas struts 885 are provided, with one end of each gas strut coupled to plate 873 and the other end of each gas strut attached to plate 877, using fasteners, such as screws. When latch mechanism 883 is operated, gas struts 885 apply a force between plates 873 and 877 causing them to slide apart in a parallel manor with respect to each other.

Figure 24:
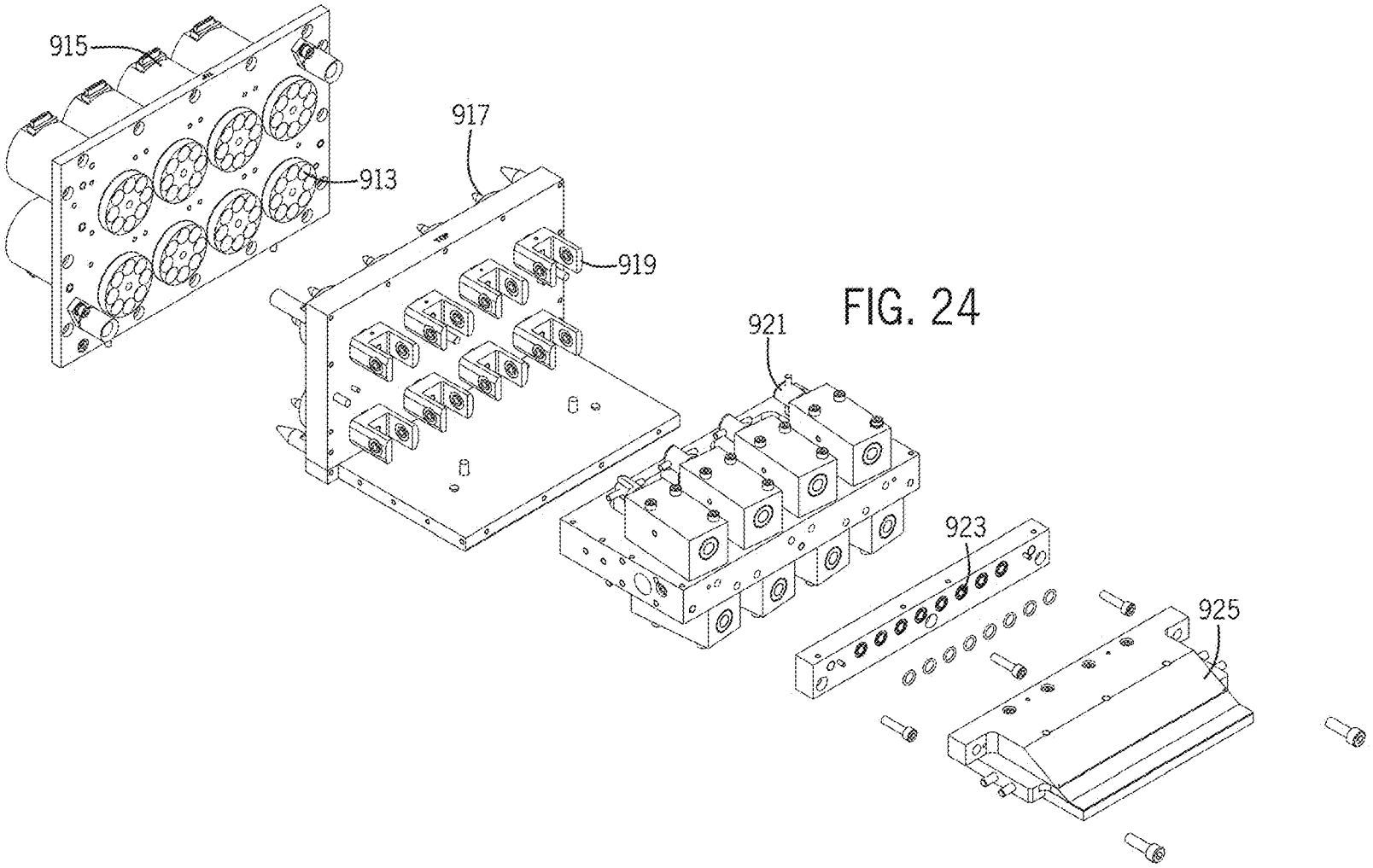

FIG. 24 is an exploded view of modules 830 and 832 of an ink distribution module. Mechanical couplers 913 are shown, one for each motor 915 to be coupled to an input shaft 917 of yokes 919. Mechanical couplers 913 may be configured to at least partially self-align with input shafts 917. For example, each input shaft 917 may have a pointed or curved end configured to slide into a corresponding recess or curved portion in mechanical coupler 913. If modules 830 and/or 832 are not aligned with sufficient precision when first brought together, the self-aligning configuration of couplers 913 and/or shafts 917 may provide better alignment. Yokes 919 each drive a corresponding piston 921 of a positive displacement pump to pump fluid from a source (ink tank) 116 and then through channels 923 and to distribution head 925.

In alternate embodiments, other sliding mechanisms may be used, including ball bearings, drawer slides, low friction surfaces, carriage and guide rails, tracks, pneumatic or air slides, telescoping slides, positioning slides (motorized or manual) or other sliding or movement mechanisms or actuators.

According to various exemplary embodiments, the power enclosure, processing circuits, and system PC described herein may comprise a memory, a local cache, a local hard disk drive, a CD-ROM, a floppy disk, a random-access data source (e.g., a RAM), a read-only data source (e.g., a ROM), an Ethernet port, a communication port, or any other volatile or non-volatile memory. According to various exemplary embodiments, the processing circuits may be any processing circuit of past, present, or future design that is capable of carrying out the processes described herein. Processing circuits may comprise analog and/or digital components, such as a microprocessor, microcontroller, application-specific integrated circuit (ASIC), field-programmable gate array (FPGA), or other electronic, mechanical, or electromechanical components, as well as any computer-readable code or software operable therewith or thereon, configured to perform the functions described herein and other known functions. The computer readable instructions may be embodied on a tangible, non-transitory computer readable medium, such as a memory device, ASIC, FPGA, etc.

All references to "a" or "an" element in this application means "at least one" or "one or more," and is not meant to refer to only a single element.

While exemplary embodiments herein are described with reference to the movement of inks, the teachings herein may be applied to the movement of other fluids, such as adhesives, varnish, water, cleaning solutions, or other fluids.

The invention claimed is:

1. A printing press for printing on metal cans, comprising:
- a conveyor configured to move cans through the press;
- a plurality of inkers, each inker configured to print a different color ink on the cans, each inker further comprising:
  - an ink distribution module, comprising:
    - a first module comprising a plurality of motors, each motor configured to drive an output shaft; and
    - a second module, comprising:
      - a plurality of ink displacement units;
      - at least one ink inlet to provide ink to the ink displacement units;
      - ink channels configured to transfer ink from the ink displacement units to ink outlets of the second module; and
      - input shafts configured to removably couple to the output shafts of the first module; and
  - at least one roller configured to receive ink from the ink displacement units and transfer the ink toward the cans; and
- at least one support member configured to support the first and second modules in at least one position relative to the roller, wherein the support member is configured to facilitate removal of the second module by a press operator for cleaning the ink channels.

2. The printing press of claim 1, wherein the first module further comprises a circuit board comprising electrical components configured to power the motors at different speeds based on control signals received at a control input port.

3. The printing press of claim 1, wherein the ink displacement units are configured for positive displacement pumping of ink.

4. The printing press of claim 3, wherein the second module has at least four separate ink displacement units.

5. The printing press of claim 1, wherein the second module weighs less than about 30 pounds.

6. The printing press of claim 1, wherein the second module comprises a distribution head configured to spread the ink received from across zones of the roller.

7. The printing press of claim 1, wherein the first module is free of any ink channels.

8. The printing press of claim 1, wherein the input shafts and output shafts are configured to mechanically self-align.

9. The printing press of claim 1, wherein the input shafts and output shafts are configured to magnetically couple.

10. The printing press of claim 1, wherein the support comprises a rail and the first and second modules are configured to slide along the rail between an operating position and a removal position.

11. The printing press of claim 10, wherein the support member is configured to release the second module when in the removal position.

* * * * *